US009840889B2

(12) United States Patent
Killie et al.

(10) Patent No.: US 9,840,889 B2
(45) Date of Patent: Dec. 12, 2017

(54) APPARATUS FOR CONTROLLING FLUID FLOW IN OR INTO A WELL AND METHOD OF USING SAME

(71) Applicant: Acona Innovalve AS, Skien (NO)

(72) Inventors: Rune Killie, Skien (NO); Vegar Gruner, Skien (NO)

(73) Assignee: Acona Innovalve AS, Skien (NO)

( * ) Notice: Subject to any disclaimer, the term of this patent is extended or adjusted under 35 U.S.C. 154(b) by 341 days.

(21) Appl. No.: 14/646,249

(22) PCT Filed: Nov. 12, 2013

(86) PCT No.: PCT/NO2013/050193

§ 371 (c)(1),
(2) Date: May 20, 2015

(87) PCT Pub. No.: WO2014/081306

PCT Pub. Date: May 30, 2014

(65) Prior Publication Data

US 2015/0308226 A1 Oct. 29, 2015

(30) Foreign Application Priority Data

Nov. 21, 2012 (NO) ..... 20121391

(51) Int. Cl.

| | |
|---|---|
| ***E21B 34/08*** | (2006.01) |
| ***E21B 43/12*** | (2006.01) |
| ***E21B 43/14*** | (2006.01) |
| ***E21B 34/10*** | (2006.01) |

(52) U.S. Cl.
CPC ..... *E21B 34/08* (2013.01); *E21B 34/10* (2013.01); *E21B 43/12* (2013.01); *E21B 43/14* (2013.01)

(58) Field of Classification Search
CPC ..... E21B 34/10; E21B 34/08; E21B 43/12; E21B 43/14; E21B 2034/002
See application file for complete search history.

(56) References Cited

U.S. PATENT DOCUMENTS

| | | | |
|---|---|---|---|
| 2006/0076150 | A1 | 4/2006 | Coronado et al. |
| 2007/0246407 | A1 | 10/2007 | Richards et al. |
| 2008/0041580 | A1 | 2/2008 | Freyer et al. |
| 2008/0041582 | A1 | 2/2008 | Saetre et al. |
| 2012/0061088 | A1 | 3/2012 | Dykstra et al. |
| 2013/0068467 | A1* | 3/2013 | Zhou ..... E21B 34/08 166/369 |

FOREIGN PATENT DOCUMENTS

| | | |
|---|---|---|
| EP | 1953336 | 8/2008 |
| GB | 2384508 | 7/2003 |

* cited by examiner

*Primary Examiner* — Brad Harcourt
(74) *Attorney, Agent, or Firm* — Gable Gotwals

(57) ABSTRACT

The present invention discloses an apparatus and a method for controlling fluid flow in or into a well. The apparatus includes at least one housing (3*m*, 3*g*, 3*w*) having an inlet (5) and at least one outlet (7, 7'), one of which is arranged in a top portion or a bottom portion of the housing (3*m*, 3*g*, 3*w*) when in a position of use, and a flow control means (9*m*, 9*g*, 9*w*) disposed within the housing (3*m*, 3*g*, 3*w*). The flow control means (9*m*, 9*g*, 9*w*) has a density that is higher or lower than a density of a fluid to be controlled and a form adapted to substantially block the outlet (7, 7') of the housing when the flow control means (9*m*, 9*g*, 9*w*) is in a position abutting the outlet (7, 7').

17 Claims, 18 Drawing Sheets

GAS

WATER

APPARATUS FOR CONTROLLING FLUID FLOW IN OR INTO A WELL AND METHOD OF USING SAME

CROSS-REFERENCE TO RELATED APPLICATIONS

This application is the United States National Phase of PCT Patent Application No. NO2013/050193 filed 12 Nov. 2013, which claims priority to Norwegian Patent Application No. 20121391 filed 21 Nov. 2012, each of which are incorporated herein by reference.

BACKGROUND OF THE INVENTION

The present invention is related to a valve. More precisely the present invention is related to an apparatus and a method for controlling fluid flow in and into a well. The apparatus is typically mounted onto or in a portion of a basepipe in a reservoir section of for example a petroleum producing well to control the flow of fluids into the well. The well may for example be a gas producing well or an oil producing well. The purpose of the apparatus is to control the inflow of various fluids that may be drained from a reservoir or utilized for preparing the well. In a well for producing gas or oil such fluids may be one or more of oil, gas and water which is drained from the reservoir, and also well construction fluids such as drilling mud and completion fluids which are used when constructing the well prior to initial start-up of production from the well.

Modern long-reach horizontal production wells for oil and gas have the objective to increase the contact to a productive reservoir. Modern drilling, both offshore and onshore, are costly operations as the initial cost of establishing a secure and cased wellbore down to the reservoir depth is mandatory, independent of the later well objective. Such wells might penetrate several thousands of meters of productive reservoir, and in order to establish desired productivity along these wellbores, proper removal of drilling fluids and other well construction fluids are required during the initial start-up and cleanup of these wells.

When oil is being produced from saturated oil segments, an influx of unwanted fluids such as gas from the overlying gas cap, or water from the underlying aquifer, is likely to occur. Such influx might be predictable or unpredictable, depending on the reservoir properties. The mobility ratio between oil and gas, or oil and water, which describes the difference in restriction against fluid flow in the reservoir, states that the least viscous fluid is restricted far less than the other fluids when flowing through a permeable reservoir. Drainage from long horizontal wells or complex, segmented, reservoirs therefore cannot be done without the risk of producing high rates of undesired gas or water.

Consequently, there is a need for an apparatus which discriminates between desired and undesired fluids.

Desired fluids in the petroleum producing industry might typically be one or more of drilling fluids, mud and completion fluids, oil, condensate or gas.

Undesired fluids might typically be one or more of gas, water or oil.

A person skilled in the art will appreciate that fluids regarded as desired or undesired will vary depending on the purpose of the well and the operational scenario.

The publication US2007246407 discloses inflow control devices for sand control screens. A well screen includes a filter portion and at least two flow restrictors configured in series, so that fluid which flows through the filter portion must flow through each of the flow restrictors. At least two tubular flow restrictors may be configured in series, with the flow restrictors being positioned so that fluid which flows through the filter portion must reverse direction twice to flow between the flow restrictors. US2007246407 also discloses a method of installing a well screen wherein the method includes the step of accessing a flow restrictor by removing a portion of an inflow control device of the screen.

In one embodiment US2007246407 suggests free-floating balls in annular chambers. If the fluid flowing through the chamber has the same density as the balls, the balls will start to flow along with the fluid. Unless a ball is trapped inside a recirculation zone, it will eventually be carried to an exit hole, which it blocks. Suction force will cause the ball to block the hole continuously until production is stopped. A production stop will cause pressure equalization, such that the ball can float away from the hole.

The publication US20080041580 discloses an apparatus for use in a subterranean well wherein fluid is produced which includes both oil and gas, the apparatus comprising: multiple first flow blocking members, each of the first members having a density less than that of the oil, and the first members being positioned within a chamber so that the first members increasingly restrict a flow of the gas out of the chamber through multiple first outlets.

Publications US2008041582 discloses an apparatus which is based on the same principles as US20080041580 mentioned above.

EP 1953336 A2 discloses an inflow control device for restricting flow into a passage of a tubular string in a wellbore includes at least two of a flow restrictor section, a fluid discriminator section and a reverse flow preventer section, and the inflow control device is configured so that fluid which flows between an exterior of the tubular string and the passage also flows through each of the at least two sections. A well screen or liner includes a filter or inlet portion and an inflow control device including a flow restrictor section, a fluid discriminator section, and a reverse flow preventer section, the inflow control device being configured so that fluid which flows through the filter portion also flows through the flow restrictor, fluid discriminator and reverse flow preventer sections.

Publication GB2384508 discloses a downhole separation tool utilizing a downhole separation chamber with a series of fluid regulators responsive to a formation fluid and constituent components for separating desirable formation yields from less desirable yields prior to lifting the fluids to the surface. The separation chamber has an input for the formation fluid, a production output, and a disposal output, in a tree arrangement according to the density order of the fluids in the separation chamber. An input flow regulator is coupled to the separation chamber input, a production regulator is coupled to the production output, and a disposal regulator is coupled to the disposal output. Each of the regulators is responsive to a fluid density of the formation fluid, first constituent and remainder constituent, to regulate the flow of the respective fluid.

The apparatus disclosed in GB2384508 separates the fluids instead of blocking them. Therefore, it makes use of separation chambers, where the flow requires a certain residence time. It works for vertical well sections only, not for horizontal well sections.

US2006076150 discloses an apparatus for controlling flow of formation fluid into a production tubular in a wellbore. The apparatus comprises a flow restriction member for controlling fluid flow into the production tubular, the flow restriction member being actuated by a phase change of the formation fluid. The phase change is typically a change in density of the formation fluid.

US2006076150 is related to control of formation fluid only which means that a change from e.g. oil-based drillmud to reservoir oil, i.e. from oil to oil, is not covered. Unless a cleanup valve is installed between each swell packer, the invention will impede well cleanup because the drillmud will be blocked.

The invention has for its object to remedy or reduce at least one of the drawbacks of the prior art or at least provide a useful alternative to the prior art.

The object is achieved through features which are specified in the description below and in the claims that follow.

According to a first aspect of the present invention there is provided an apparatus for controlling fluid flow in or into a well, the apparatus comprising:

at least one housing arranged between a main inlet being in fluid communication with fluid upstream of the apparatus and a main outlet being in fluid communication with fluid downstream of the apparatus, the housing having a top portion located in an upper elevation of the housing and a bottom portion located in a lower elevation of the housing when the apparatus is in a position of use, the housing further having:

an inlet for allowing fluid flow into the housing and at least one outlet for allowing fluid flow out of the housing, the outlet being, arranged in one or both of the top portion and the bottom portion of the housing; and a flow control means disposed movably within the housing between said top portion and bottom portion, the flow control means having a density being higher or lower than a density of a fluid to be controlled so that a position of the flow control means within the housing depends on the density of the flow control means relative to the density of the fluid only, and a shape adapted to substantially block the outlet of the housing when the flow control means is in a position abutting the outlet in said top portion or the bottom portion; wherein the apparatus is further provided with a leakage means configured for allowing leakage of fluid out of at least one of a top portion and a bottom portion of the housing independent of the position of the flow control means.

Providing flow control means having a density being higher or lower than a density of a fluid to be controlled has the effect that the position of the flow control means within the housing, depends on the mutual density of the fluid and control means only. Thus, the apparatus will be fully autonomous without any need for power or communication with any control means outside the well.

Providing leakage means configured for allowing leakage of fluid out of at least one of a top portion and a bottom portion of the housing independent of the position of the flow control means has the effect that one fluid within the housing may be displaced by another fluid thereby enabling re-opening or de-activation of the flow control means after being activated. Further important effect of the leakage means will be discussed in the specific part of the description.

The leakage means may be an aperture provided in a portion of the housing. The aperture may be provided by means of at least one recess in a periphery of the outlet, or an aperture arranged outside of the periphery of the outlet. The latter will be necessary if a leakage means is desired in an end portion of the housing not provided with an outlet.

As an alternative to, or additional to the aperture, the leakage means may be provided by means of a surface of the flow control means being non-compliant with a periphery of the outlet so that a desired leakage is provided therebetween. This has the effect that fluid may seep or leak past a flow control means being in a position blocking an outlet of the housing.

It is emphasised that a fluid flow through the leakage means is very limited as compared with a fluid flow through an unblocked outlet from the housing.

The at least one housing may comprise at least a first housing and a second housing arranged in series where one of the at least one outlet from the first housing is in fluid communication with the inlet of the second housing, and wherein the flow control means disposed in the first housing has a density different from the density of the flow control means disposed in the second housing. This has the effect of enabling multiple configurations of the apparatus to accomplish a desired functionality for a given well.

Typical area of application will be to restrict gas and water in an oil producer, or to restrict water in a gas producer, while allowing for well cleanup of drilling and completion fluids during initial well start-up.

A portion of the housing may be provided with a fluid soluble substance for initially fixing the flow control means in a predetermined position. This has the effect that the flow control means may be restricted from movement within the housing during well start-up and thus provide improved clean-up functionality by allowing unblocked flow of fluid through the apparatus for a certain period during start-up.

The apparatus may be further provided with at least one bypass means comprising a channel for bypassing at least one housing, the bypass means being provided with a fail-safe flow control means arranged in a portion of the channel. The fail-safe flow control means may also be utilized as a so-called late-life control means.

Preferably, the fail-safe or late-life control means is initially fixed in the bypass means by means of a soluble substance sealing off the bypass means. When the soluble substance is exposed to a fluid dissolving the soluble substance, the fail-safe flow control means is activated. The fluid dissolving the soluble substance may be introduced into the well from the surface, or it may be the fluid flowing into the well from the formation.

In order to prevent the fail-safe flow control means from flowing out of the apparatus and for example into the pipe, a fluid permeable restriction means may be arranged in a portion of the bypass means. Preferably, the permeable restriction is made from a material being resistant to any fluids flowing in the well.

Apparent from the above, the apparatus is dependent on a correct orientation in order to function as intended. One typical way of ensuring correct orientation, which should be known to a person skilled in the art, is by allowing a specific part of one or each completion section where an apparatus is installed to rotate freely, and use e.g. a specifically designed wire-line tool to position and lock each section to its correct orientation prior to well start-up. An alternative to forced orientation by a wire-line tool is to design an apparatus with a heavy section of the perimeter allowing the apparatus to self-rotate into correct orientation prior to initial well start-up. To lock the apparatus in correct position, e.g. hydrocarbon swelling packaging could be installed on the rotating section to swell and lock position with the formation wall.

However, it is desired to provide an apparatus that is more reliable and fully autonomous without any need for power or communication with any control means outside the well.

According to a second aspect of the present invention there is provided an orientation dependent inflow control apparatus for controlling fluid flow from an outside to an inside of a pipe in a deviated or horizontal well, the inflow control apparatus comprising:

a first housing having a longitudinal axis and provided with a first inlet being in fluid communication with fluid outside of the pipe and a first outlet;

a second housing having a longitudinal axis and provided with a second inlet and a second outlet; wherein:

said outlets being provided in an end portion of the housings, the first outlet being in fluid communication with the second inlet and the second outlet is arranged for fluid communication with an inside of the pipe;

a movable blocking member arranged within each of the housings and configured for allowing blockage of the outlets by moving along said longitudinal axis by gravity or buoyancy towards the end portion having the outlet, the movable blocking member having a density being higher than the highest density fluid present in the well during at least a period of the lifespan of the well or lower than the lowest density fluid present in the well during at least a period of the lifespan of the well;

wherein the first housing and the second housing are arranged mutually distant in or at a perimeter of the pipe such that an angle of inclination of the first housing is different from that of the second housing.

In order to provide a reliable "on-off valve" the blocking members have in one embodiment a density that is at least twice that of the fluid in the well having the highest density.

In one embodiment the outlet from the second housing of the orientation dependent inflow control apparatus is arranged for fluid communicating with the inside of the pipe via an apparatus according to the first aspect of the invention. Thus, the apparatus according to the first aspect of the invention will be fed with fluid only if fluid is allowed through the orientation dependent inflow control apparatus. Therefore, the orientation dependent inflow control apparatus comprises at least two inflow control apparatuses distributed around the pipe. In one embodiment is four apparatuses equidistantly distributed around the pipe so that at least one is sufficiently orientated to provide desired functionality, as will be better understood when studying some of the embodiments disclosed in the specific part of the description.

According to a third aspect of the present invention there is provided a method for controlling fluid flow in or into a well, wherein the method comprising the steps of: mounting an apparatus according to the first aspect of the invention as part of the well completion string prior to inserting the string in the well, the apparatus comprising at least one housing being provided with a flow control means having a desired density with respect to the density of fluids to be controlled; and bringing the well completion string into the well.

In what follows is described an example of a preferred embodiment which is visualized in the accompanying drawings, in which.

Figure 3:
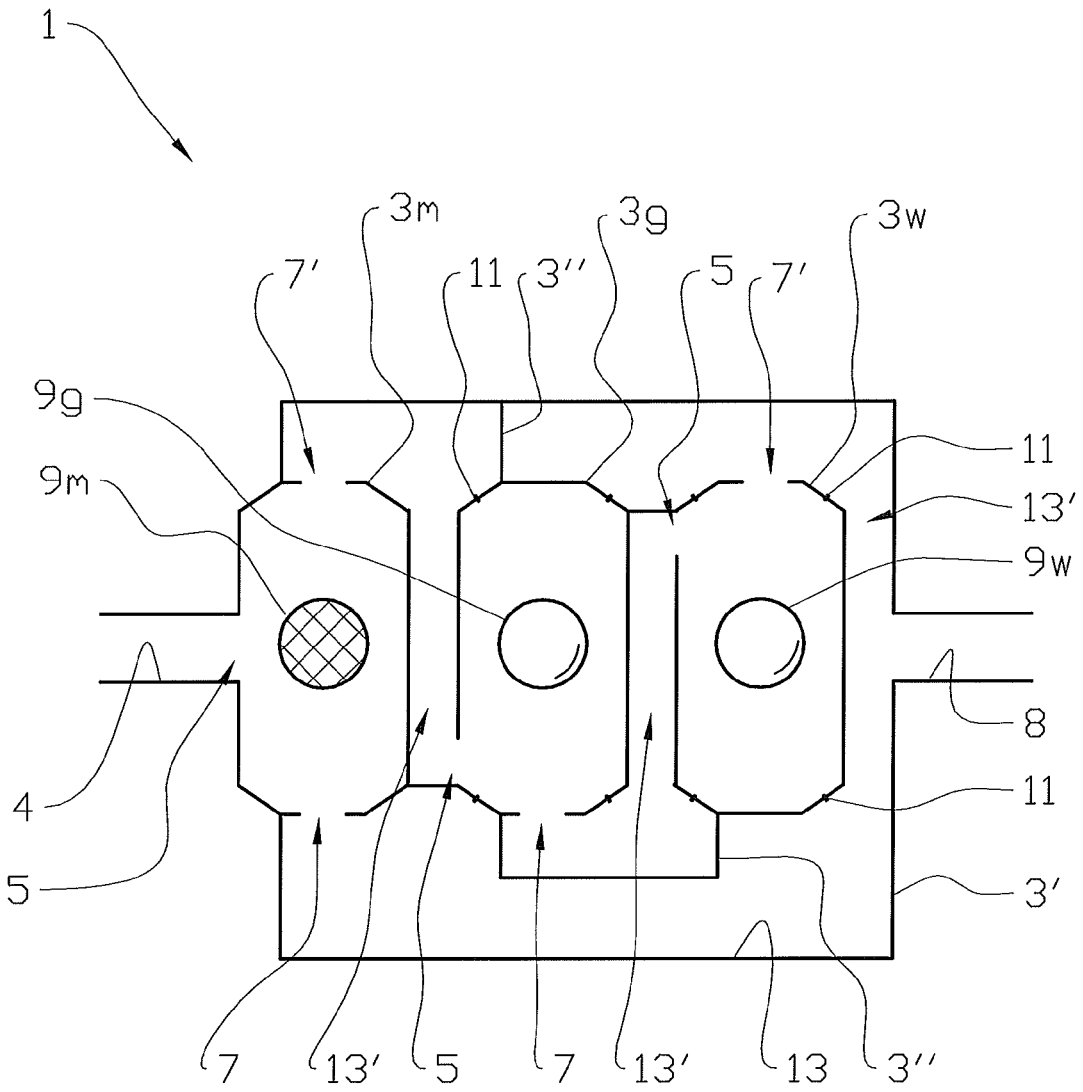
FIG. 3 shows an apparatus comprising three housings arranged in series.
Figure 5A:
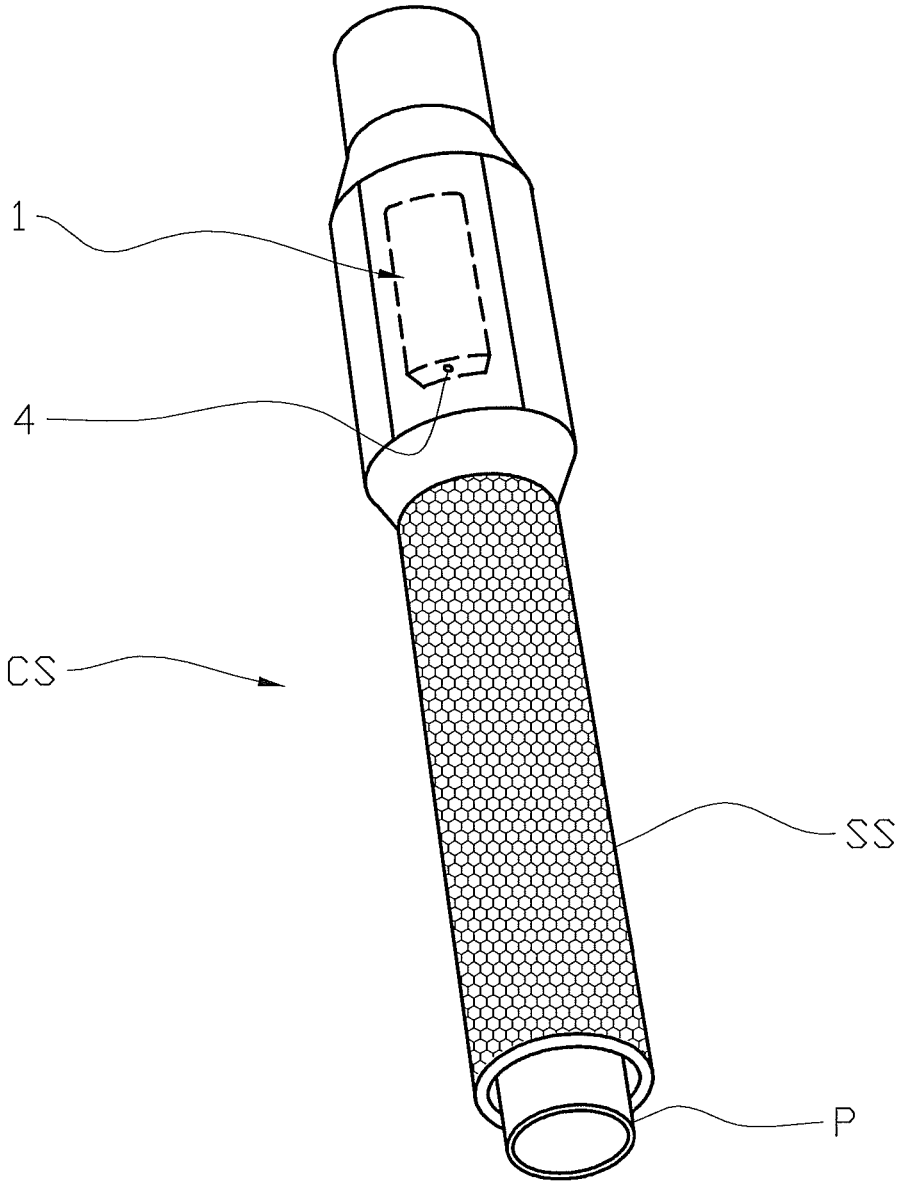
Figure 5B:
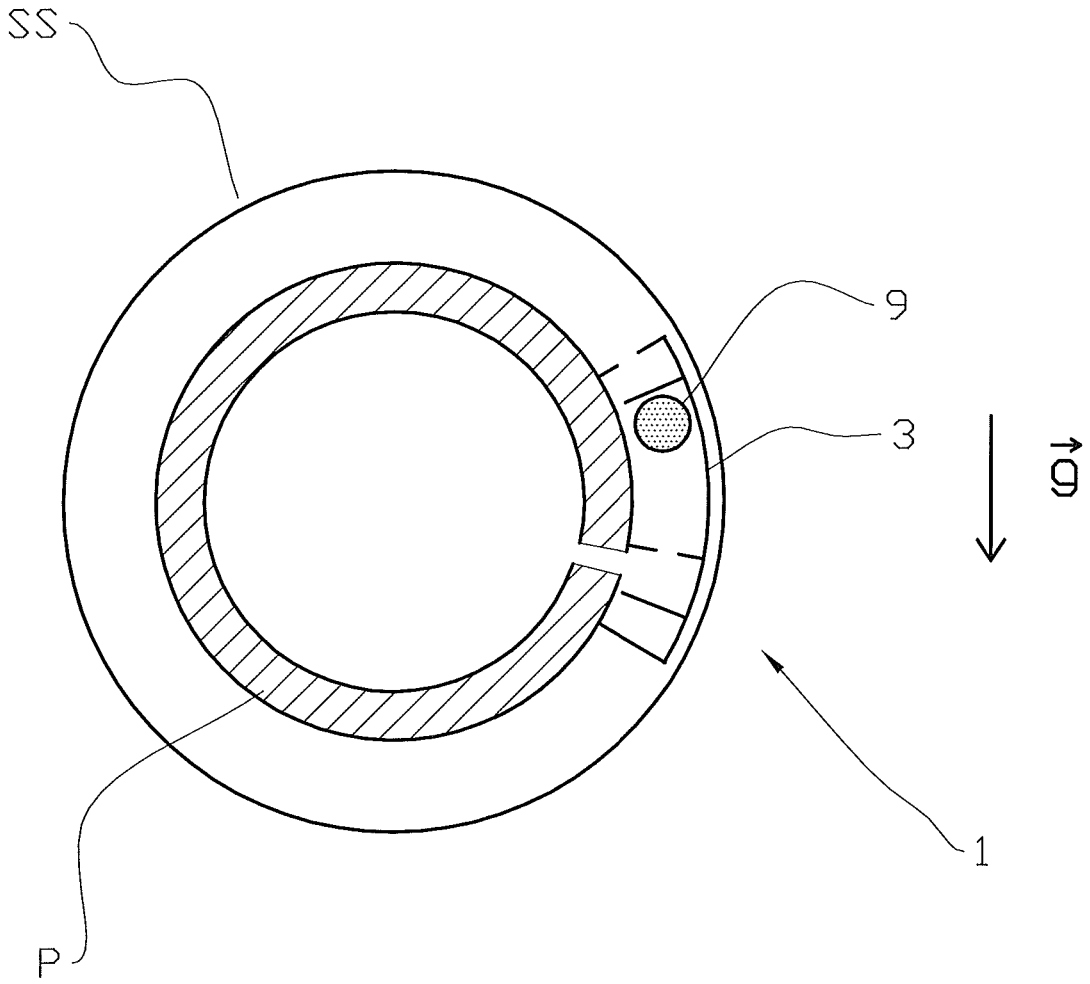

FIGS. 4*a*-4*d* illustrates the apparatus in FIG. 3 in scenarios where four different fluids flow through the apparatus;

FIG. 5*a* shows a perspective view of a pipe stand comprising a base pipe and a screen, and an apparatus according to the present invention;

FIG. 5*b* shows a principle cross section through a portion of FIG. 5*a;*

Figure 5C:
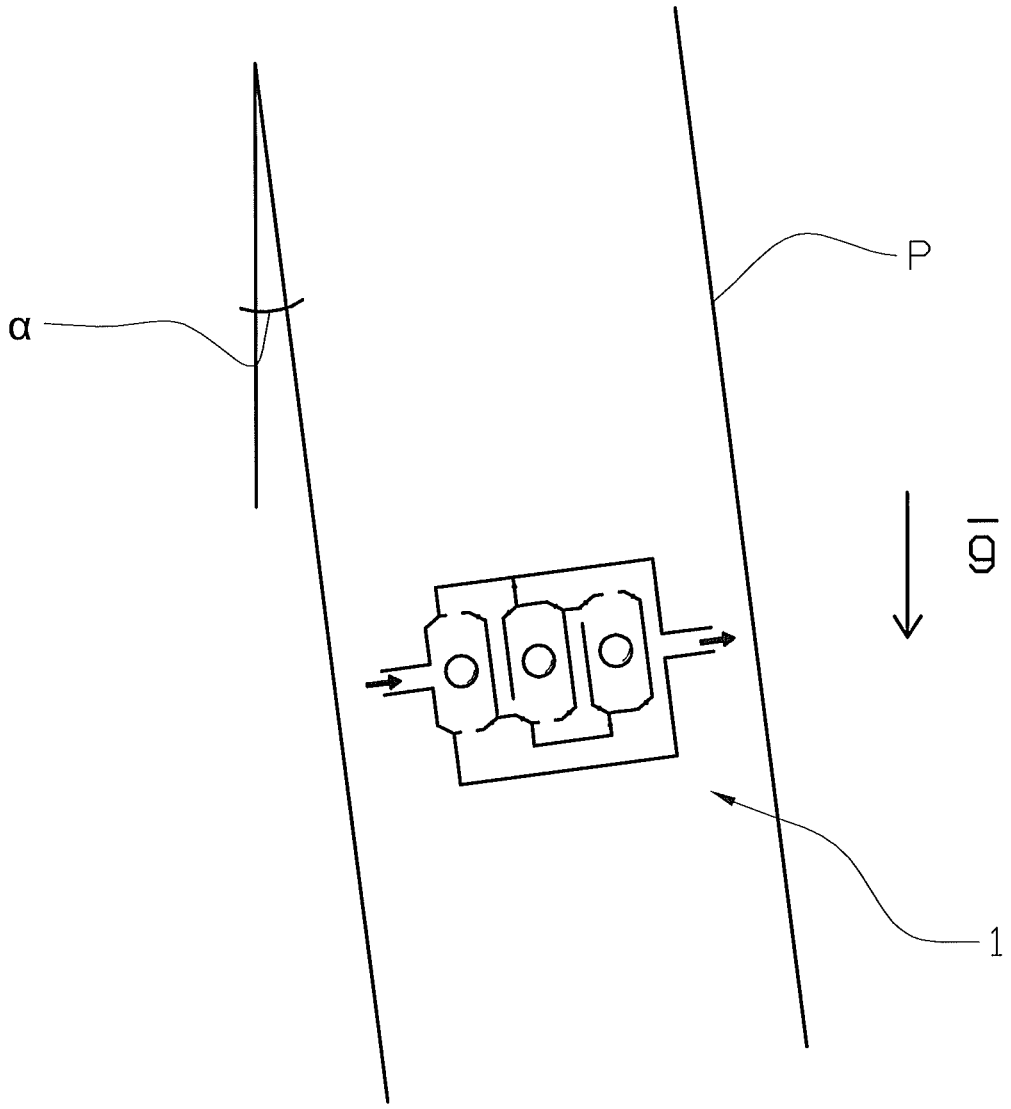
Figure 6:
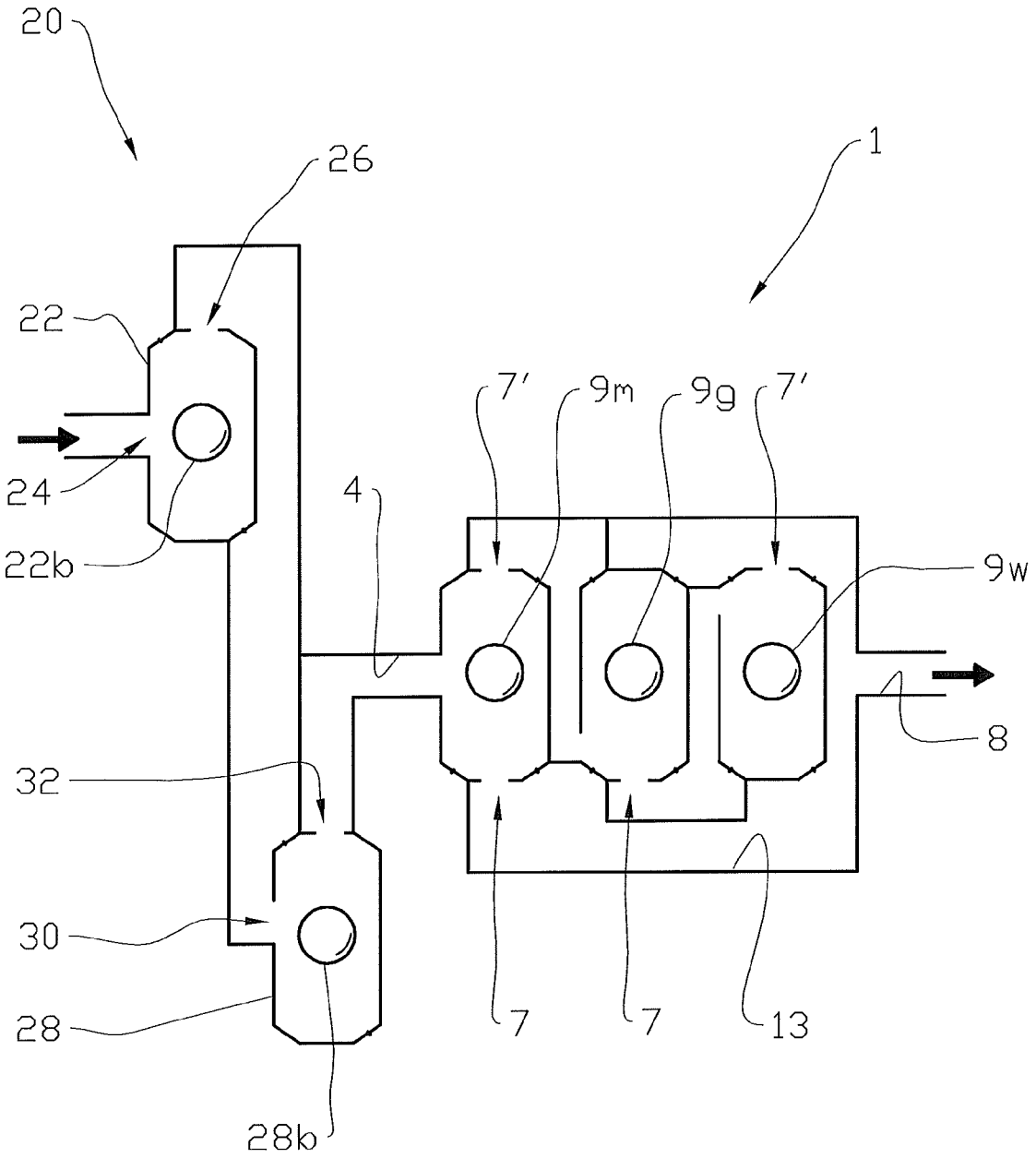
Figure 7:
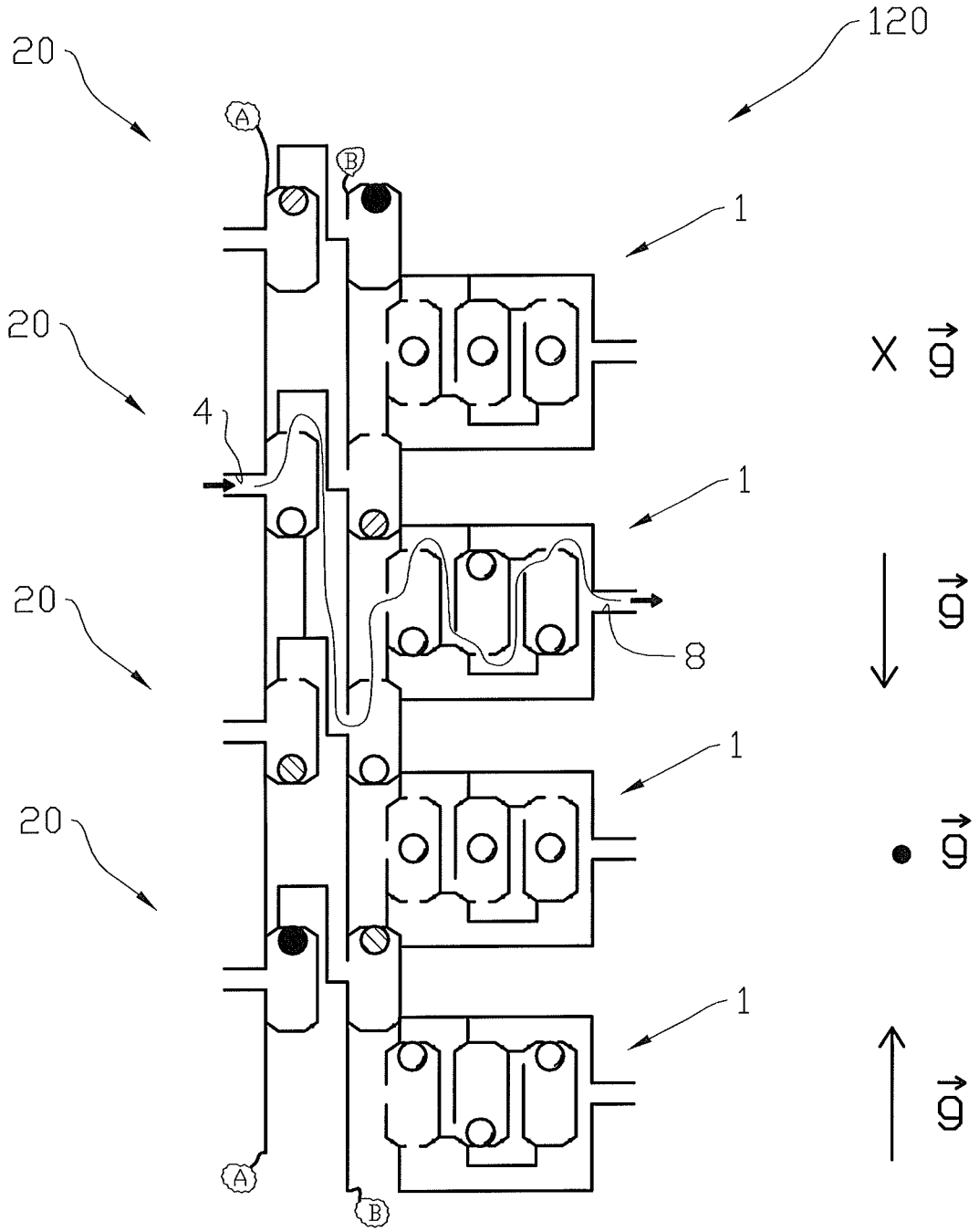
Figure 8:
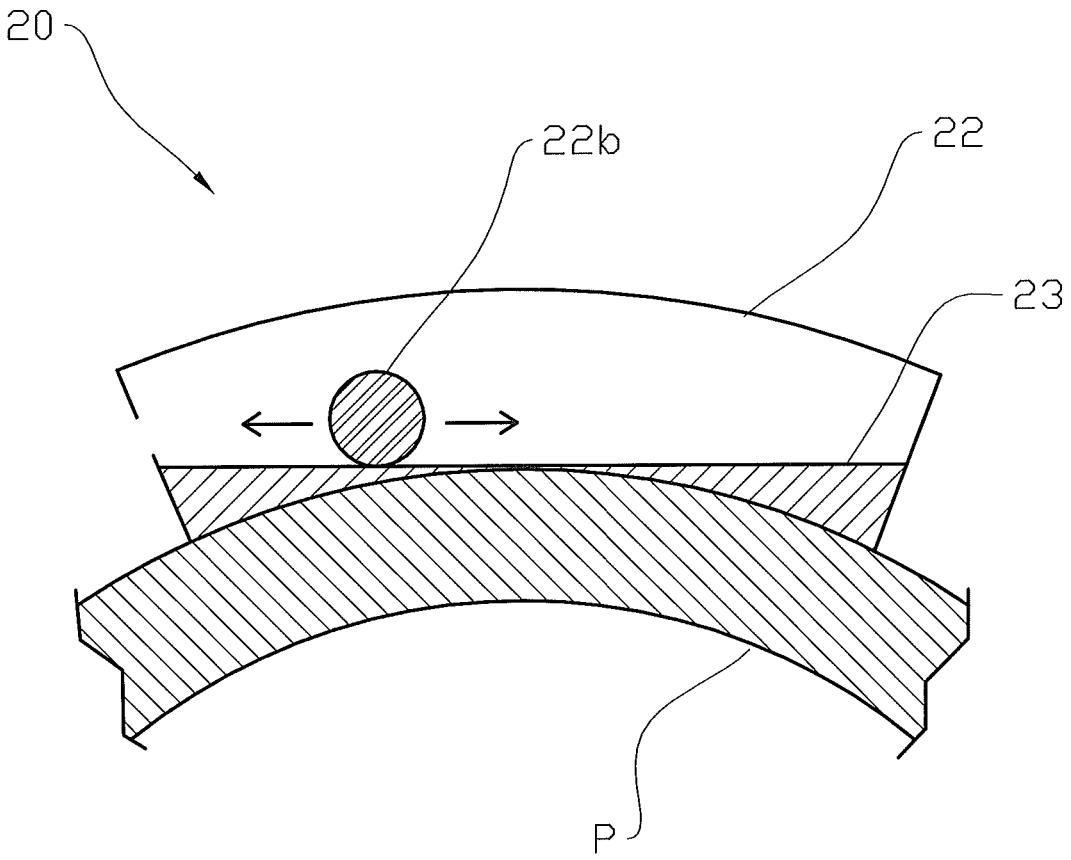
Figure 9:
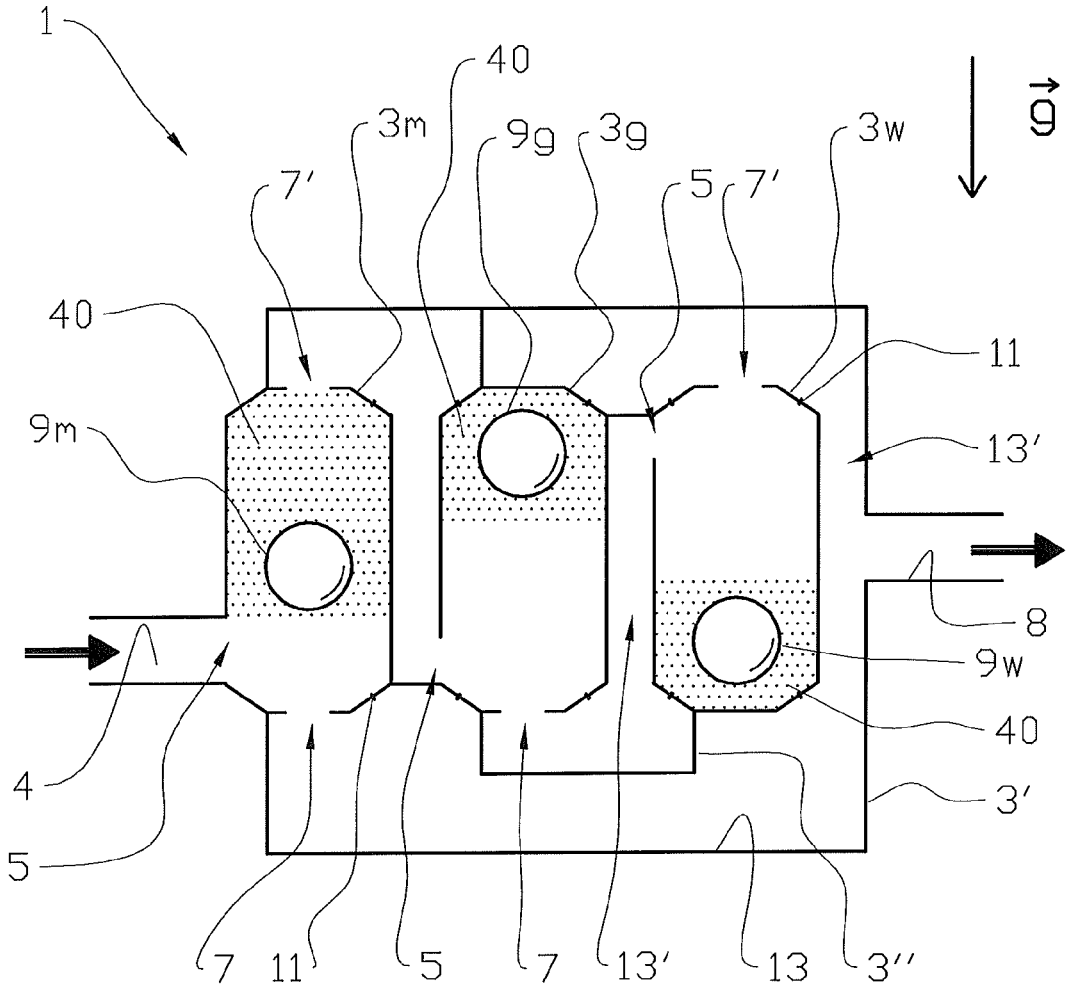
Figure 10:
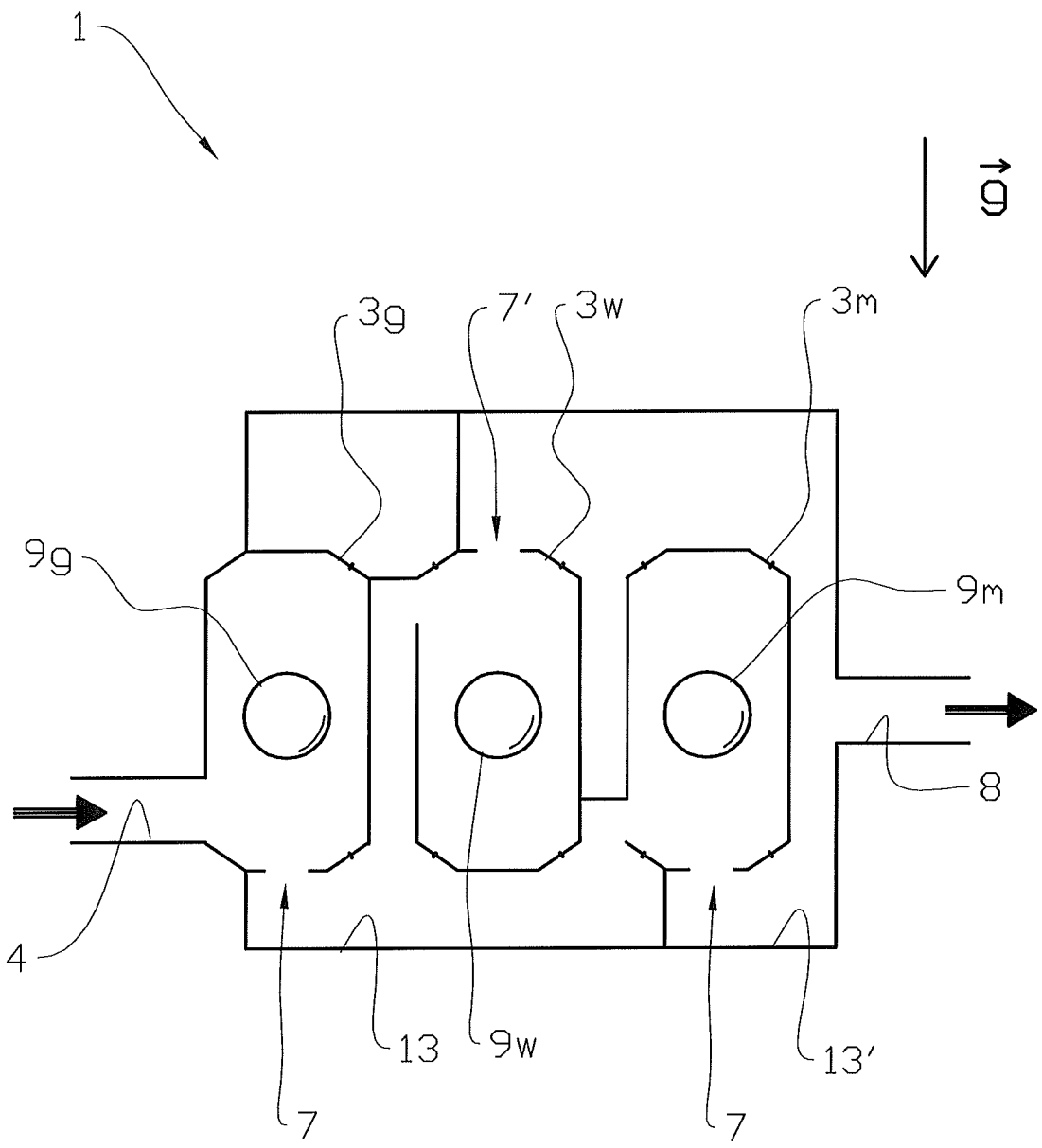
Figure 11:
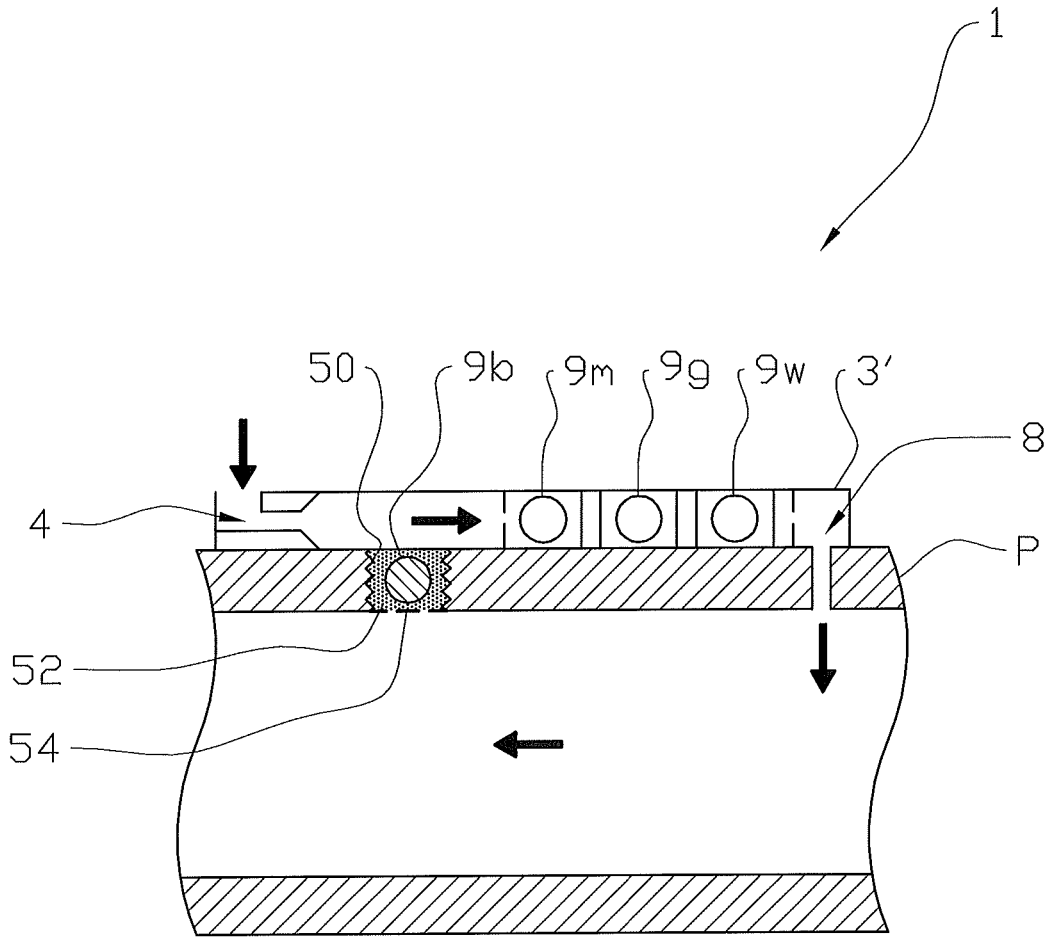
Figure 12:
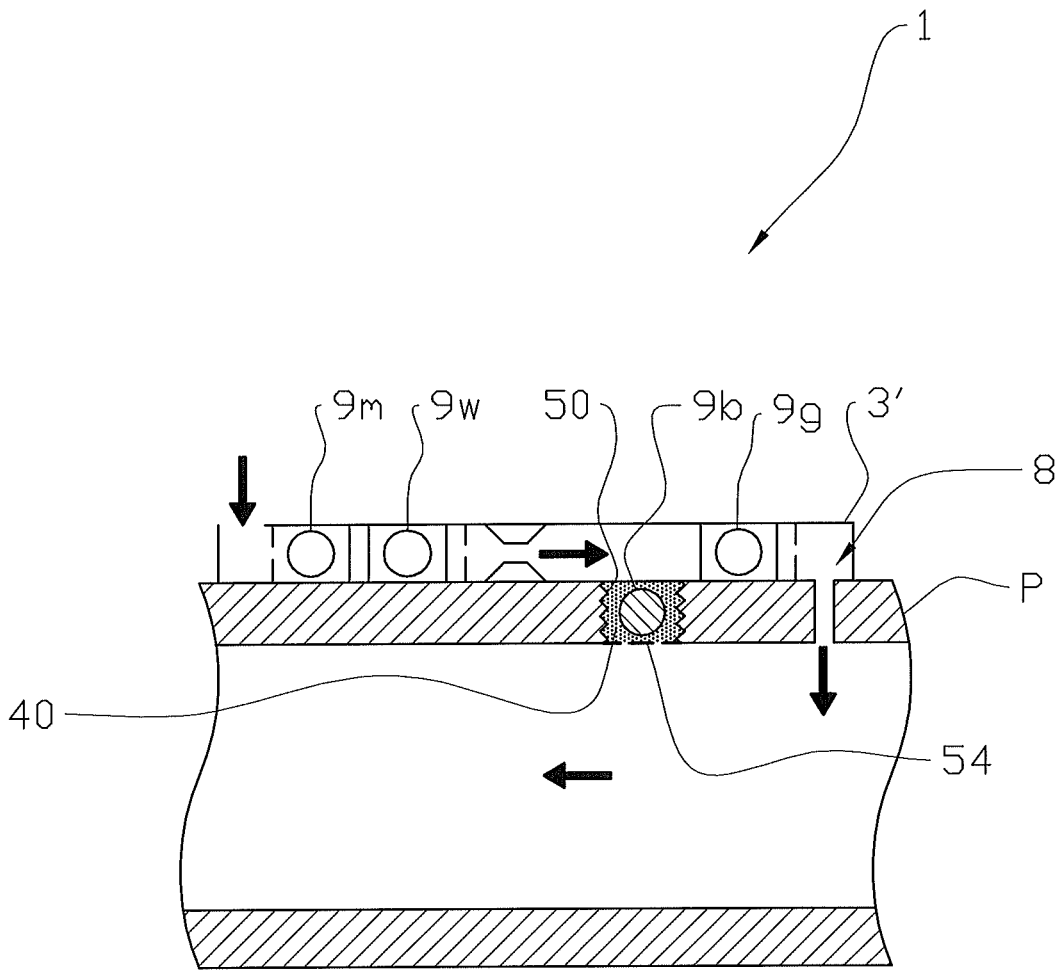
Figure 13:
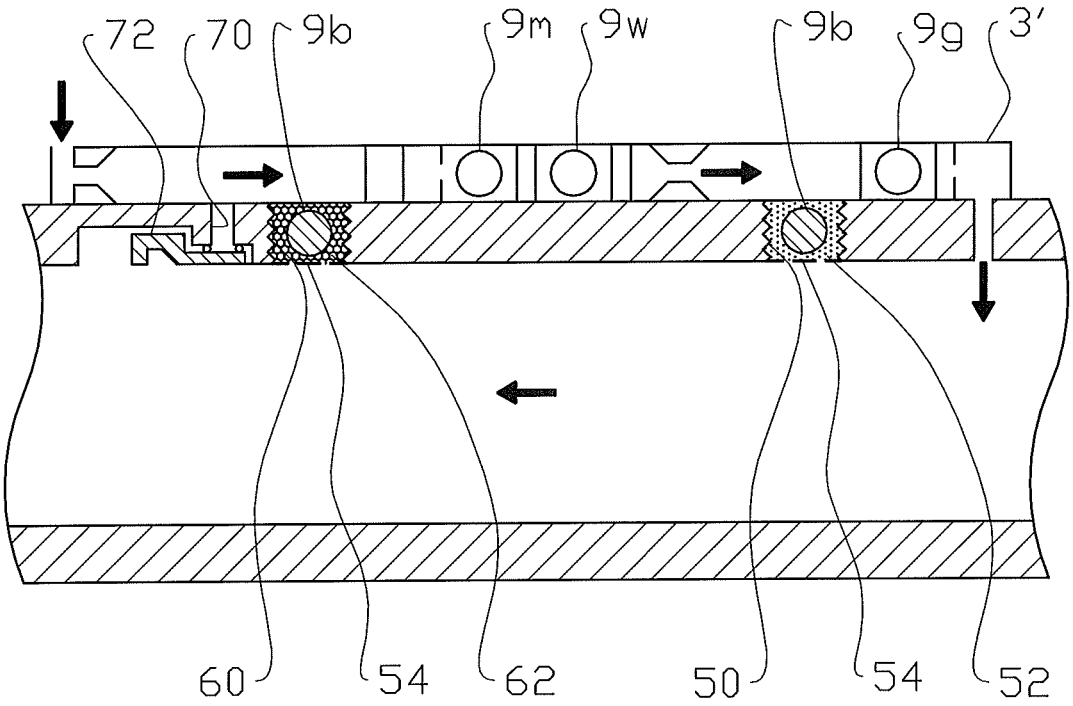

FIG. 5*c* shows a principal drawing of apparatus orientation/placement in a vertical/deviated well;

FIG. 6 shows the apparatus in FIG. 3 having an inlet in fluid communication with an orientation dependent inflow control apparatus according to a second aspect of the present invention;

FIG. 7 shows a rolled out view of four apparatuses in FIG. 6 arranged equidistantly around a pipe;

FIG. 8 shows a cross sectional view of a portion of the orientation dependent inflow control apparatus;

FIG. 9 shows the apparatus in FIG. 3 wherein the apparatus is provided with a soluble substance for initially restricting movement of the flow control means;

FIG. 10 shows an alternative configuration of the apparatus in FIG. 3;

FIG. 11 shows a cross-sectional view of the apparatus in FIG. 3 further including a bypass channel;

FIG. 12 shows an alternative configuration of the apparatus in FIG. 12; and FIG. 13 shows a configuration of the apparatus with multiple fail-safe and well conversion possibilities;

Positional indications such as for example "above", "below", "upper", "lower", "left", "right", refer to the position shown in the figures.

Same or corresponding elements are indicated by same reference numerals in the figures.

A person skilled in the art will understand that the figures are just principle drawings. The relative proportions between individual elements may also be strongly distorted.

In the figures, the reference numeral 1 denotes an apparatus according to a first aspect of the present invention.

Figure 1:
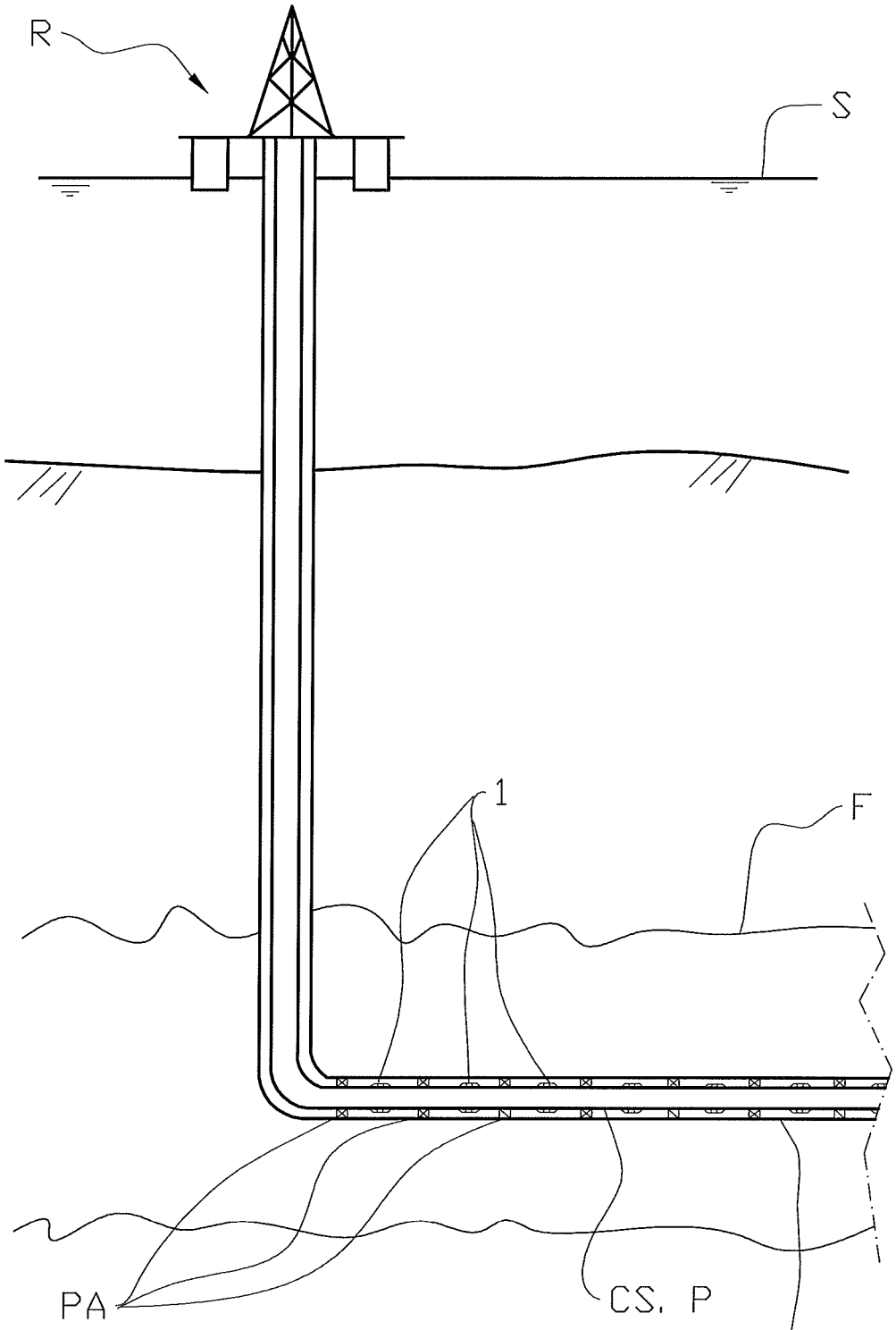
FIG. 1 shows a principle sketch of a typical subsea well having a plurality of apparatuses according to the present invention distributed along a horizontal section of the well.

FIG. 1 shows a typical use of the apparatus 1 in a well completion string CS arranged in deviated or horizontal wellbore W penetrating a reservoir F. The well W is in fluid communication with a rig R floating in a surface of a sea S. The well W comprises a plurality of zones separated by packers PA as will be appreciated by a person skilled in the art. A person skilled in the art will understand that the well may alternatively be an onshore well.

Figure 2:
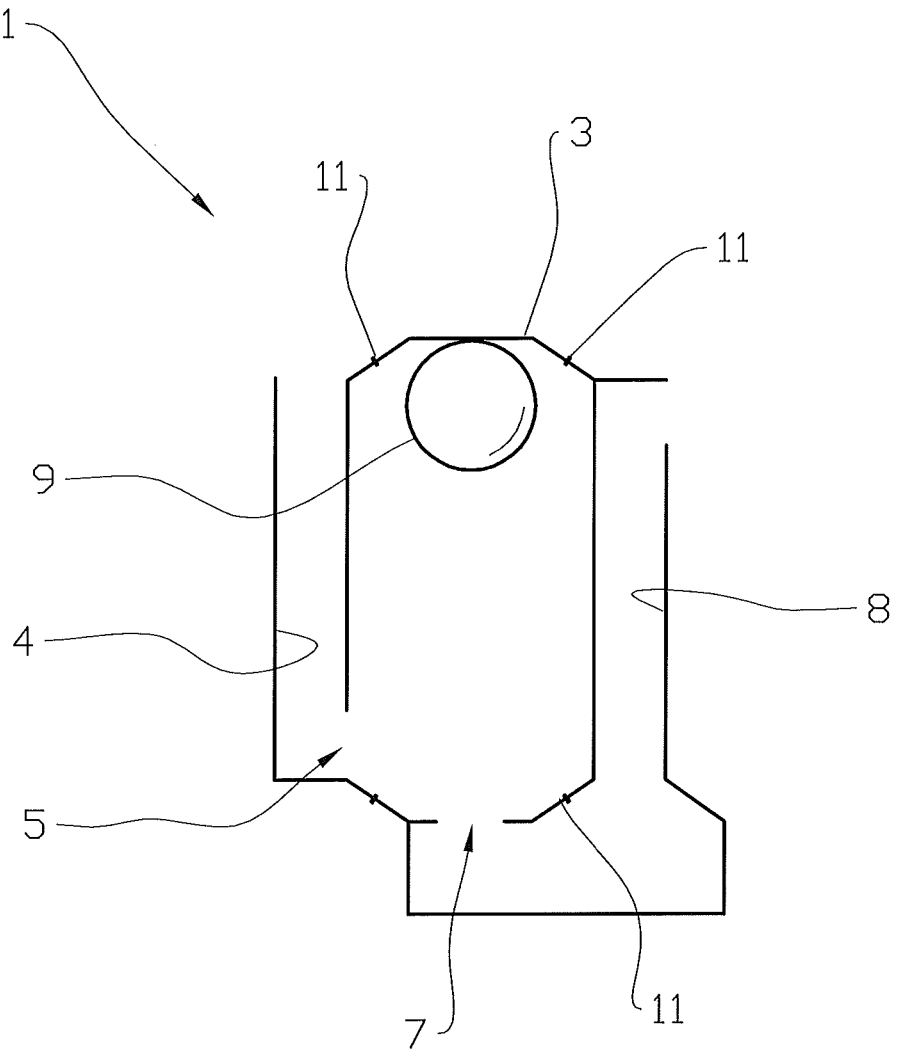
FIG. 2 shows in larger scale an apparatus having a single housing.

FIG. 2 shows a principle sketch of a very basic configuration of the apparatus 1. The apparatus 1 comprises a housing 3 provided with an inlet 5 and an outlet 7 arranged in a bottom portion of the housing 3. The housing 3 has an oblong form.

A flow control means 9 provided by means of a ball is arranged within the housing 3. The flow control means, or ball 9, has a density that is adapted to the density of relevant fluid to be controlled. The fluid to be controlled may for example, but not limited to, be drilling mud, oil, gas and water.

Figure 4A:
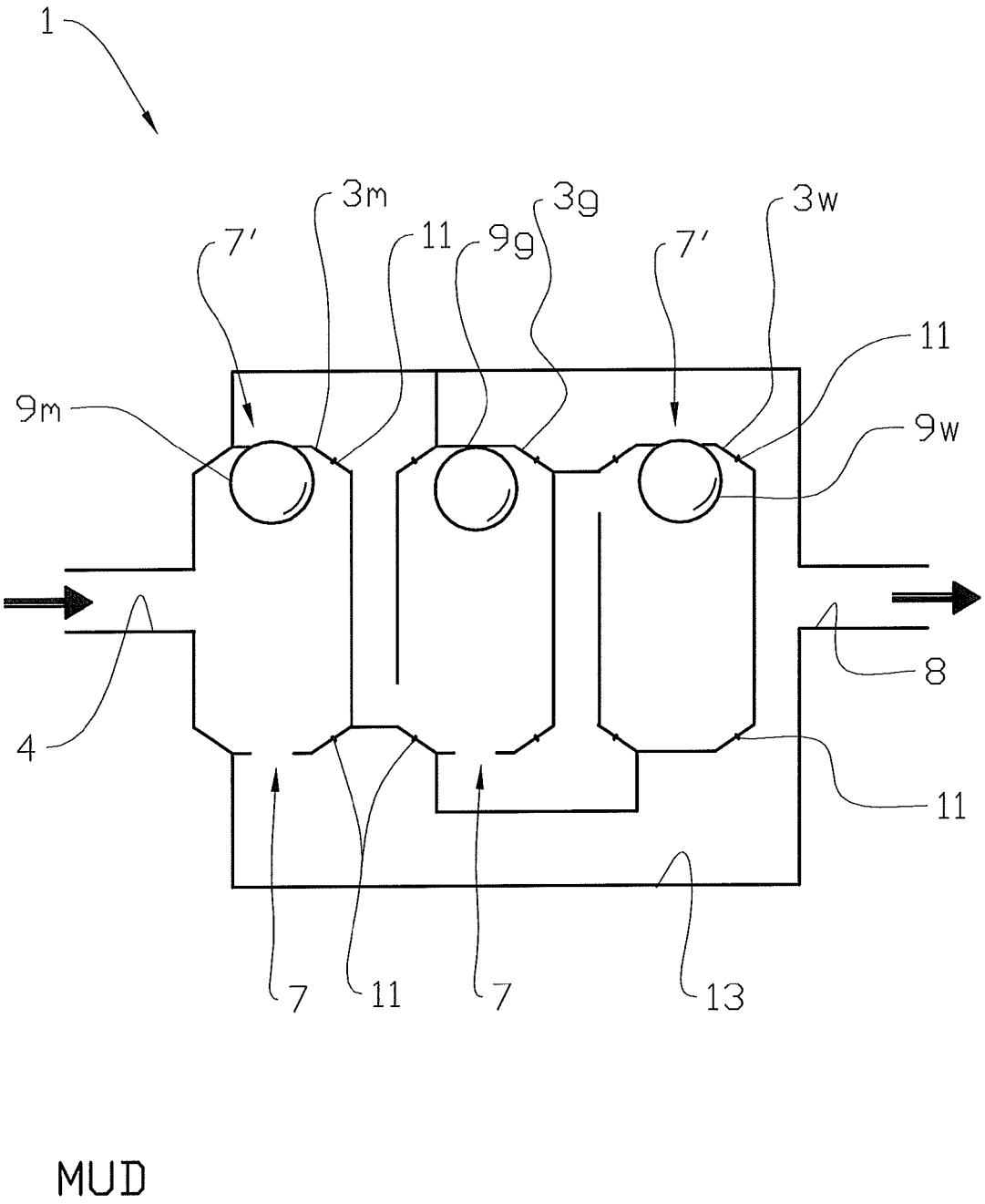

The size and form of the ball 9 is adapted to be able to substantially block the outlet 7 when abutting it as shown e.g. in FIG. 4*a*.

The housing 3 is further provided with a leakage means 11 for allowing continuous leakage of fluid out of the housing 3 even when the outlet 7 is blocked by the ball 9. In the figures the leakage means 11 is meant to illustrate apertures in the housing 3. Thus, a first fluid within the housing 3 may be displaced by a second fluid in a situation where inflow of fluid into the apparatus 1 changes. The importance of the leakage means 11 will be understood when studying FIG. 4*c* wherein the apparatus is blocking flow of a gas through the apparatus 1. Without the leakage means 11 in the top portion of the mid-housing 3*g*, any gas entrapped in the housing 3*g* could not be displaced by another fluid of higher density if the inflow of fluid is changing. Thus, flow control means 9 within the housing 3*g* would still block the outlet 7 and thereby still block fluid flow through the apparatus 1.

The apparatus 1 in FIG. 2 is further provided with an apparatus inlet conduit 4 and an apparatus outlet conduit 8. The apparatus inlet conduit 4 is typically in direct communication with the annular space outside a basepipe P (see FIG. 5*a*) of the well completion string CS. The annular space is in contact with the reservoir F, and the flow from the reservoir could or could not be filtered by e.g. a screen before entering the apparatus inlet conduit, hereinafter also denoted main inlet 4. The apparatus outlet conduit 8, hereinafter also denoted main outlet 8, is typically in fluid communication with an aperture in the basepipe of the well completion string W.

In FIG. 3 the apparatus 1 comprises three housings 3 arranged in series. In the following the housings from left to right will be denoted by reference numerals 3*m*, 3*g* and 3*w* respectively and the flow control means within the housings 3*m*, 3*g* and 3*w* will be denoted by reference numerals 9*m*, 9*g* and 9*w* respectively.

In FIG. 3 the flow control means, or ball, 9*m* has a grid-like surface pattern illustrating a series of ridges and valleys providing a non-even surface. The purpose of the non-even surface is to provide a leakage means 11 allowing a small leakage or seep out of fluid between the periphery of the outlet 7, 7' and the ball 9*m* when this abuts one of the outlets 7, 7'. Note that the leakage means 11 in the left housing 3*m* is provided by said non-even surface of the ball 9*m* instead of the apertures 11 arranged in the mid-housing 3*g* and in the right housing 3*w*.

As an alternative to, or in addition to, the non-even surface of the ball 9*m*, the leakage means may be provided by means of an outlet 7, 7' having a periphery being non-compliant with the surface of a ball 9*g*, 9*w* having an substantially smooth surface.

The left housing 3*m* is provided with an inlet 5 which is in fluid communication with the main inlet 4 of the apparatus 1. The housing 3*m* is further provided with a bottom outlet 7 and a top outlet 7' arranged in the bottom portion and in the top portion respectively. The bottom outlet 7 is in fluid communication with the main outlet 8 via a bypass channel 13. The top outlet 7' is in fluid communication with an inlet 5 of the mid housing 3*g*.

The mid housing 3*g* is provided with a bottom outlet 7 only which is in fluid communication with and inlet 5 of a right housing 3*w*. The right housing 3*w* is provided with a top outlet 7' only which is in fluid communication with the main outlet 8 of the apparatus 1.

The apparatus 1 is provided with an outer enclosure or housing 3' and compartment elements 3" as shown in FIG. 3 to provide the desired flow communications within and out of the apparatus 1.

It is emphasised that the configuration shown in FIG. 3 is only one example of a configuration of the apparatus 1 and that different arrangements, order of housings 3*m*, 3*g*, 3*w* and/or balls 9*m*, 9*g* and 9*w* or other configurational variations of the apparatus 1 may be provided by the present invention. FIG. 10 is an example of such a variation.

In FIGS. 4*a* to 4*d* the apparatus in FIG. 3 is configured for different stages of the well life of an oil producing well. Note that in FIGS. 4*a* to 4*d* the non-even surface ball 9*m* shown in FIG. 3 is replaced by a ball 9*m* having a similar surface as the balls 9*g* and 9*w*, and that the housing 3*m* is provided with leakage means in the form of apertures 11.

Note that only some of the reference numerals shown in FIG. 3 is repeated in the FIGS. 4*a* to 4*d*.

The direction of fluid flow into and out of the apparatus 1 is indicated by arrows.

In FIGS. 4*a* to 4*d* the density of the ball 9*m* is higher than that of oil, water and gas, but lower than that of mud. The mud may for example be drilling mud or a well construction mud. The density of the ball 9*g* is higher than that of gas, but lower than that of mud, oil and water. The density of the ball 9*w* is higher than that of gas and oil, but lower than that of mud and water.

In FIG. 4*a* mud will flow through the apparatus 1 from the main inlet 4 to the main outlet 8.

Figure 4B:
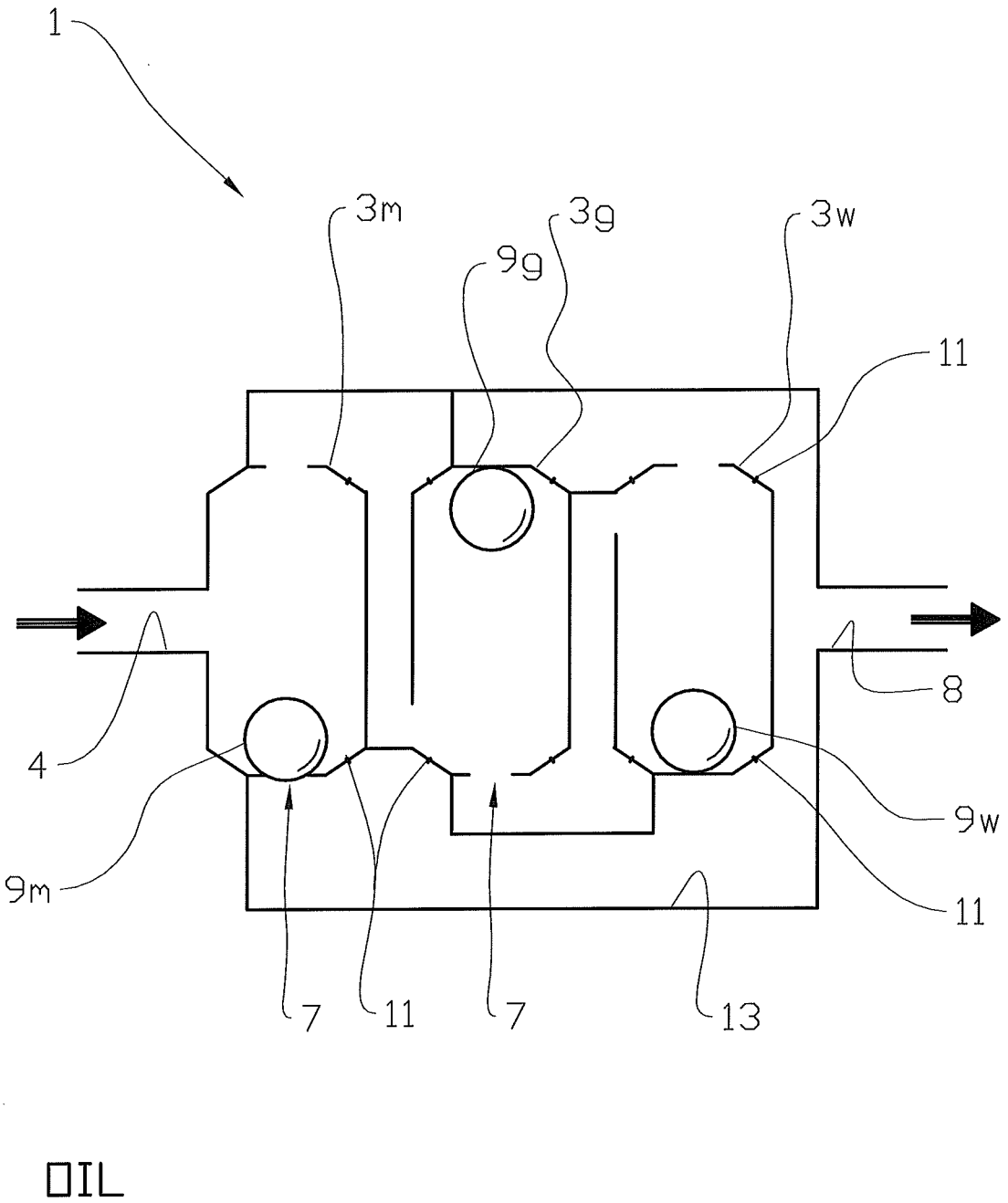

In FIG. 4*b* oil will flow through the apparatus 1 from the main inlet 4 to the main outlet 8.

Figure 4C:
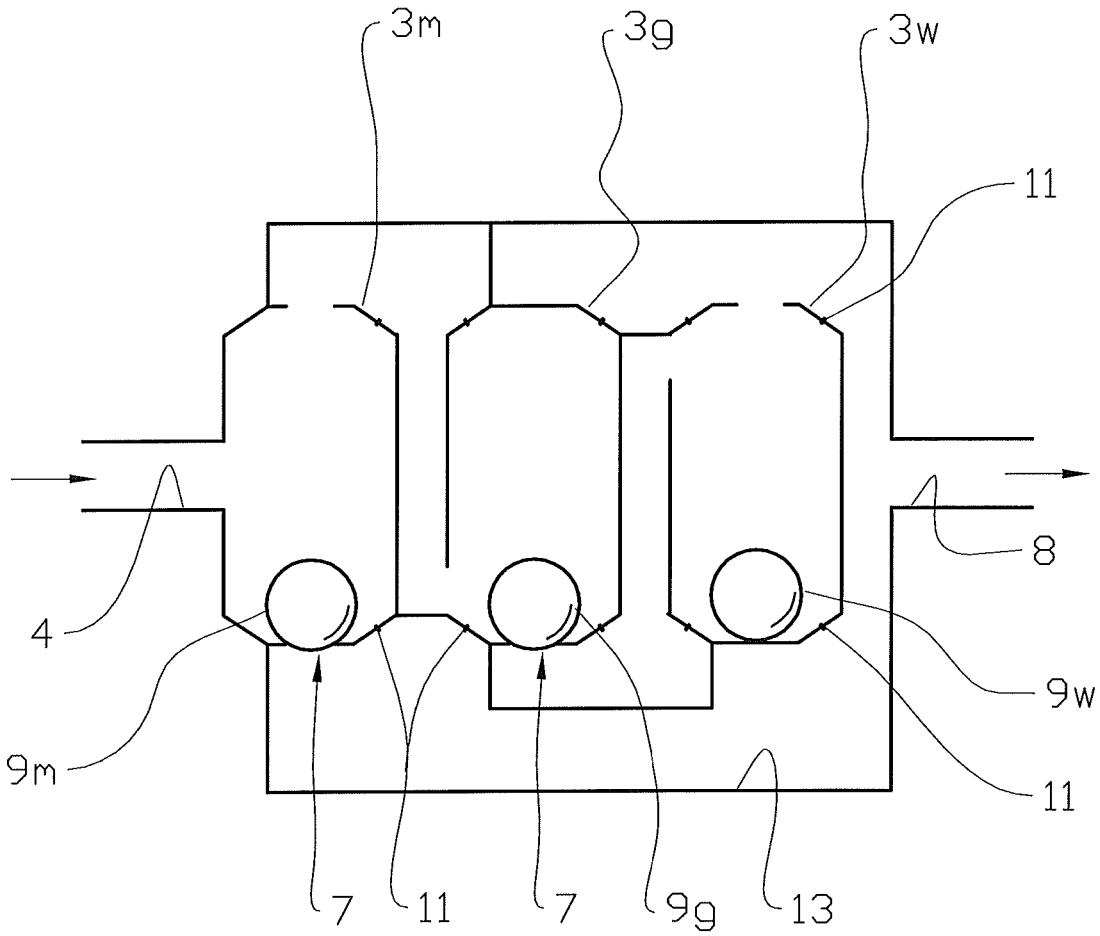
Figure 4D:
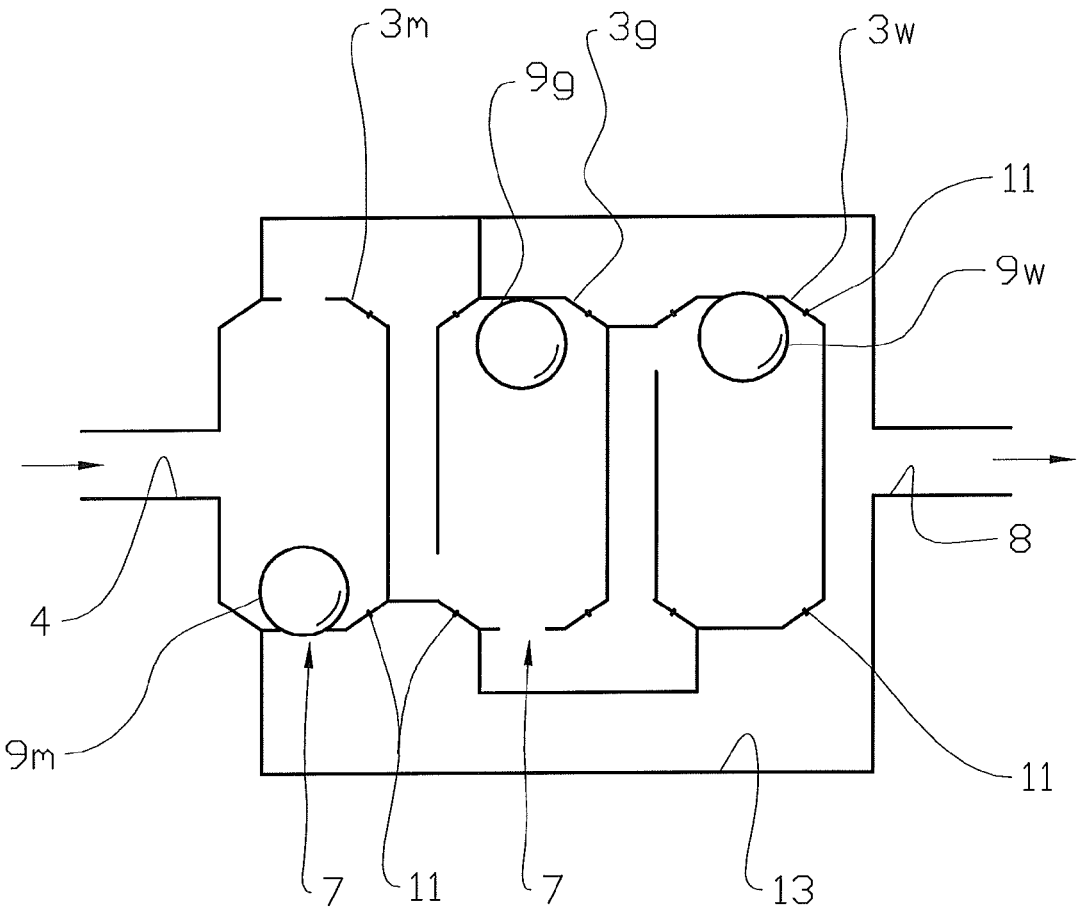

In FIGS. 4*c* and 4*d* gas and water respectively will be substantially restricted from flowing through the apparatus 1. The only passage through the apparatus 1 is via the apertures 11. This very limited flow is indicated by small arrows in the main inlet 4 and main outlet 8.

The reason for this is explained as follows:

After entering the main inlet 4 of the apparatus 1 the fluid flow enters the left housing 3*m* designed to bypass e.g. well construction fluids through the bypass channel 13 directly to the main outlet 8.

Due to the density of the ball 9*m* being higher than the formation water (second densest fluid) and lower than the well construction fluid (densest fluid), the dense well construction fluid is present in all spaces in the apparatus 1 prior to well start-up/cleanup. This means that the balls 9*m*, 9*g* and 9*w* will initially be positioned at the top portion of the housings 3*m*, 3*g* and 3*w* respectively due to their buoyancy with respect to the dense well construction fluid.

During initial well start-up/cleanup, the well will thus start flowing construction fluid through the main inlet 4 and the bypass channel 13 to the main outlet 8 as shown in FIG. 4*a*. Simultaneously there will be a small flow through the leakage means shown as apertures 11 and internal flow channels generally denoted 13' in FIG. 3.

Initially, the flow will substantially comprise well construction fluids. After some time, the well construction fluid will be cleaned out and reservoir fluid will start to flow. In the configuration shown in FIGS. 4*a* to 4*d* the apparatus 1 is designed to let through oil, and restrict gas and water from the reservoir. Assuming the reservoir fluid produced after cleanup of the well construction fluid is oil, the density of the ball 9*m* is such that it will lose its buoyancy in the reservoir fluid.

However, due to the suction forces in the top outlet 7' of the left housing 3*m*, the ball 9*m* will keep its position. The apertures or leak holes 11 and internal flow channels 13' will facilitate total fluid displacement in the subsequent housings 3*g* and 3*w*.

After substantially all of the well construction fluid is displaced by oil the ball 9*g* will, due to its density between the densities of gas and oil, maintain its position at the top of the housing 3*g*. The ball 9*w* will, due to its density higher than that of oil and lower than that of water, sink to a position at the bottom of the housing 3*w*.

Due to the suction forces in the top outlet 7' of the left housing 3*m*, the ball 9*m* will keep its position, as mentioned above. This means that neither housing 3*g* nor housing 3*w* is supplied with fluid from the outlet of the left housing 3*m*. Thus, the fluid flows via the bypass channel 13 through the apparatus. This flow pattern will continue until the well has its first production shut down, typically as part of a start-up procedure when so-called well cleanup is satisfactory.

After re-start-up of the well after a first planned production shutdown, the balls 9*m*, 9*g* and 9*w* will have found their correct positions for the current reservoir fluid as shown in FIG. 4*b*.

Assuming oil from the reservoir, ball 9*m* will sink and block bottom outlet 7 due to its density between the densities of water and the well construction fluid. The flow will then be forced to pass through the top outlet 7' and into the housing 3*g*. There, the ball 9*g* will be buoyant due to its density between the densities of oil and gas, and the fluid will flow unrestricted through the housing 3*g* and out the outlet 7 via internal channel 13' into the housing 3*w*. In the housing 3*w* the ball 9*w* will, due to its density higher than that of oil and lower than that of water, be positioned at the bottom of the housing, and the fluid will pass unrestricted through the housing 3*w* and via internal flow channel 13' to the main outlet 8.

In a later stage of the well life, if gas coning or any other phenomena introduces free gas in the fluid stream from the reservoir through the apparatus 1, the ball 9*g* will lose its buoyancy and drop down to block the main flowpath through outlet 7 of the housing 3*g*, as shown in FIG. 4*c*.

If the gas-oil contact later pulls back and formation surrounding the apparatus 1 is refilled to oil, the old fluid (gas) in the apparatus 1 will be displaced to the new fluid (oil) by the continuous leak flow through the leak holes 11. Without the leak holes 11, or any other leakage means, the high or low density fluid activating the flow control means 9*m*, 9*g* and 9*w* will not be displaced and re-opening would be disabled. Thus, the leakage means 11 will prevent fluid from being "trapped" within the apparatus 1, and the apparatus 1 will be autonomous also for such a situation.

The leakage means 11 are located or arranged in the housings 3*m*, 3*g* and 3*w* in such a way that there are substantially no zones where any type of fluid is trapped when a new fluid is surrounding for example the main inlet 4 of the apparatus 1.

If, when flowing oil from the reservoir through the apparatus 1 via top outlet 7' of the housing 3*m*, through housings 3*g* and 3*w* via internal flow channel 13' to the main outlet 8, water is introduced by water coning or other phenomena, the ball 9*w* will, due to its density below that of water become buoyant and rise to block the main flow through the top outlet 7' of the housing 3*w* and thus through the apparatus 1. This is shown in FIG. 4*d*.

FIG. 5*a* shows a typical arrangement of the apparatus 1 in a portion of a well completion string CS. The apparatus 1 is positioned between the basepipe P and a screen SS.

The apparatus 1 may form part of a so-called pipe stand having a typical length of approx. 12 meters. However, the apparatus may also be arranged in a separate pipe unit having a typical length of only 40-50 centimeters. Such a unit may be configured to be inserted between two subsequent pipe stands.

FIG. 5*b* shows typical placement of the housing 3 in a cross section of the completion string CS. The placement shown in FIG. 5*b* is optimal with respect to the gravitational vector g, but rotation around the basepipe P axis up to a certain angle is acceptable. As the apparatus 1 is orientation dependent, proper orientation of the apparatus 1 around the basepipe axis is required in horizontal or near-horizontal sections of the well. In vertical or deviated sections of the well, orientation around the basepipe P axis might not be required. Typical placement of an apparatus in a vertical or deviated well is shown in principle in FIG. 5*c*.

Ensuring correct orientation of the apparatus 1 as shown in FIG. 3 in a horizontal section could be handled by e.g. an appropriate tool when e.g. running the completion. One typical way known per se of ensuring correct orientation is by allowing the specific part of each completion section where the apparatus is installed to rotate freely, and use e.g. a specifically designed wire-line tool to position and lock each section to its correct orientation prior to well start-up. An alternative to forced orientation by a wire-line tool is to design the apparatus with a heavy section of the perimeter allowing the apparatus to self-rotate into correct orientation prior to initial well start-up. To lock the apparatus in correct position, e.g. hydrocarbon swelling packaging could be installed on the rotating section to swell and lock position with a formation wall.

In FIG. 6 a main inlet 4 of an apparatus 1 similar to the apparatus 1 shown in FIG. 3, is in fluid communication with outlet 24 of an orientation dependent inflow control apparatus 20. The purpose of the inflow control apparatus 20 is to control fluid flow from an outside to an inside of a pipe in a deviated or horizontal well. The inflow control apparatus 20 will hereinafter also be denoted orientation independent or autonomous orientation interpreting apparatus 20. The inflow control apparatus 20 is an alternative to forced orientation and self-orientation as discussed above.

The orientation dependent inflow control apparatus 20 in FIG. 6 comprises a first housing 22 having a longitudinal axis and being provided with a first inlet 24 and a first outlet 26; a second housing 28 having a longitudinal axis and a second inlet 30 and a second outlet 32. The outlets 26, 32 are arranged in an end portion of the housings 22, 28 respectively. The first outlet 26 is in fluid communication with the second inlet 30, and the second outlet 32 is arranged for fluid communication with the main inlet 4 of the apparatus 1 according to the first aspect of the invention.

A blocking member 22*b*, 28*b* is arranged within each of the housings 22, 28 respectively. The blocking members 22*b*, 28*b* are configured for allowing blockage of the outlets 26, 32 for shutting off fluid flow through the inflow control apparatus 20. The blocking members 22*b*, 28*b* have a density being higher than that of the well fluid with the highest density possible during the lifespan of the well or lower than that of a well fluid with lowest density during the lifespan of the well. Steel is an example of a suitable material for use as a high density blocking member.

The first housing 22 and the second housing 28 are arranged mutually distant in or at a perimeter of a pipe such that an angle of inclination of the first housing 22 is different from that of the second housing 28. Thus, the flow through the apparatus 20 may be blocked either by the blocking member 22*b* in the first housing 22, or by the blocking member 28*b* in the second housing 28.

When rotated around a basepipe P axis above a predefined angle, the blocking member 22*b* will abut and block the outlet 26 of the first housing 22 and thus prevent a fluid flow through the apparatus 20 and into the subsequent apparatus 1.

When rotated around the basepipe P axis below a predefined angle, the blocking member 22*b* will be positioned in a lower portion of the housing 22. The fluid may then flow out through the outlet of the first housing 22. However, because the apparatus 20 is rotated below a predefined angle, the blocking member 28*b* will abut and block the outlet 32 of the second housing 28 and thus prevent a fluid flow through the apparatus 20 and into the subsequent apparatus 1.

When the orientation dependent inflow control apparatus 20 is arranged at a predefined angle, which may be a span of angles, both of the blocking members 22*b* and 28*b* will be positioned away from the outlets 26 and 32 and fluid may flow through the inflow control apparatus 20 and into the apparatus 1.

By arranging a plurality of orientation dependent inflow control apparatuses 20 for example independently of each other and for example equidistantly around the perimeter of the basepipe P, at least one of the apparatuses will probably be within a desired predefined angle and thus enable fluid flow through the apparatus 20 and assure the correct functionality of the apparatus 1 according to the first aspect of the invention, without risk of unwanted fluid bypassing balls 9*m*, 9*g*, 9*w*. The apparatuses 1 around the perimeter of the basepipe being positioned at unfavorable angles will be disabled by the orientation dependent inflow control apparatus 20.

FIG. 7 shows a rolled-out view (360°) of a device comprising four orientation dependent inflow control apparatuses 20 equidistantly distributed around the perimeter outside of a basepipe (not shown).

In FIG. 7 the reference indications A shown in clouds are connected to each other. The same applies to the reference indications B shown in clouds.

Each of the four orientation dependent inflow control apparatuses 20 is in fluid communication with a corresponding apparatus 1 as disclosed in FIG. 6 to form an apparatus assembly 120.

The orientation of each assembly is indicated by the g-vectors g where the indication X is to be understood to be in a direction into the drawing, the downward arrow is in a direction vertically down, the dot is in a direction out of the drawing and the upward arrow is in a direction vertically up.

The assembly 120 is in the embodiment shown in FIG. 7 assumed placed in an oil well in a section where oil is being produced.

In order to facilitate the understanding of FIG. 7, each pair of blocking members 22*b*, 28*b* of each of the orientation dependent inflow control apparatuses 20 are indicated by dissimilar hatching. However, it should be understood that all of the eight blocking members 22*b*, 28*b* may be identical and that the dissimilar hatchings only serve to identify pairs of blocking members 22*b*, 28*b* within each of the four orientation dependent inflow control apparatuses 20.

As shown in FIG. 7 only one of the four orientation dependent inflow control apparatuses 20 has an orientation where both of the blocking members 22*b*, 28*b* have a position in a bottom portion of their respective housings 22, 28 and thus allow fluid flow through the orientation dependent inflow control apparatus 20 and into the subsequent apparatus 1. The flow is indicated by an arrow into the inlet 24 followed by a spline running through the orientation dependent inflow control apparatus 20 and by an arrow out of the outlet 8 of the apparatus 1. Note that the apparatus 1 which is open to fluid flow therethrough corresponds to the apparatus shown in FIG. 4*b*.

For the other three orientation dependent inflow control apparatuses 20 at least one of the blocking members 22*b*, 28*b* block an outlet 26, 32 of the respective housings 22, 28 and thus prevents a flow of fluid through the orientation dependent inflow control apparatuses 20 and into the subsequent apparatuses 1.

As mentioned above, the high density blocking members 22*b*, 28*b* in each of the four orientation dependent inflow control apparatuses 20 shown in FIG. 7 typically have the density of steel and will find their correct position regardless of type of fluid surrounding them.

If low density blocking members were used instead of the high density blocking members 22*b*, 28*b* shown in the figures, a person skilled in the art will understand that the outlets from the houses 22, 28 must be arranged in the opposite portion of the apparatuses 20 such that the outlet of each housing 22, 28 is blocked when the blocking members "float up".

To ensure reliable operation of the apparatus 20, the housings 22, 28 could be provided with a substantially flat portion or floor 23, as illustrated in FIG. 8 by the cross section of a portion of the orientation dependent inflow control apparatus 20 shown in FIG. 6 and FIG. 7. If a flat floor 23 is not used in the housings 22, 28, the placement of these housings 22, 28 should take into account that the completion string is normally rotated during installation.

If low density blocking members were used (not shown) the flat portion should be arranged in the top portion or "roof" of the housing 22.

The discussion above is an example of one way of using the apparatus 1 according to the present invention. However, the apparatus 1 may be tailor made for specific purposes.

The apparatus in FIG. 3 could be optimized for use in so-called gas producers as to only discriminate water in a gas/condensate producer. This could be achieved by simply removing the flow control means or ball 9*g*, or by removing the entire housing 3*g* so that the apparatus 1 comprises only two housings 3*m* and 3*w* instead of the three housings 3*m*, 3*g*, and 3*w* as shown in FIG. 3. The same configuration could be used for undersaturated oil producers where gas is not expected through the lifetime of the well. Similarly, the apparatus in FIG. 3 could be designed to only discriminate gas by removing the flow control means or ball 9*w*, or by removing the entire housing 3*w*.

The apparatus shown in FIG. 3 could be designed to be a part of the original completion, typically at the end of each section of a completion string CS, with or without a screen SS as shown e.g. in FIG. 5*a*. A section is typically about 12 meters.

The apparatus 1 may also be designed to be a part of a re-completion of an existing well with the re-completion being set inside the original completion or replacing the original completion. The main inlet 4 and the main outlet 8 shown in FIG. 3 would then be in fluid communication with the flow path within the completion.

In FIG. 9 the apparatus 1 shown in FIG. 3 is provided with a soluble substance 40, such as for example oil-soluble maleic resin or rosin modified phenolic resin. The purpose of the soluble substance 40 may be to provide an improved well clean-up.

In FIG. 9 the flow control means 9*m*, 9*g* and 9*w* are retained or fixed in soluble, typically hydrocarbon soluble, substance 40. The setup in FIG. 9 assumes the use of water based mud when drilling the well and assumes further the well to be an oil producer, but this could also be configured for other types of mud and other types of well.

Typically, a plurality of apparatuses 1 as shown in FIG. 9 are spread out along the producing zones of the well, for example as indicated in FIG. 1.

During well cleanup the drill mud will follow the path from the main inlet 4 via the left housing 3*m* and lower outlet 7 through bypass channel 13 to the main outlet 8. At this stage the lower part of the well will be completely filled with water based mud.

When the annular space surrounding the apparatus 1 is cleaned free from mud, oil will start to flow from the reservoir through the same path, i.e. from the main inlet 4 via the left housing 3*m* and lower outlet 7 through bypass channel 13 to the main outlet 8.

When oil fluid starts to flow through the apparatus 1, the hydrocarbon soluble substance 40 will start to dissolve in the contact area between the oil and soluble substance 40.

After some time, the soluble substance 40 will be dissolved to such an extent that it no longer will be able to retain the ball 9*m*. When the ball 9*m* is freed it will due to its density higher than that of oil, drop down and create a closed, or substantially closed, seal with the lower outlet 7 of the housing 3*m*. At this stage the flow from the reservoir through the apparatus 1 will be greatly restricted and the only flow through the apparatus 1 will be through the bottom leak hole 11 in the housing 3*m*.

The configuration as shown in FIG. 9 will typically be made for all apparatuses to be positioned in the so-called heel and mid section of the well W (see FIG. 1).

While the invention has been described with a certain degree of particularity, changes could be made in the details of construction and the arrangement of components without departing from the spirit and scope of this disclosure. The invention is not limited to the preferred embodiments described here, but is limited only by the scope of the attached claims, including the full range of equivalency to which each element thereof is entitled.

The end of the toe section of the well W will typically have the configuration shown in FIG. 3, without the soluble substance shown in FIG. 9.

The above will ensure that when a section is cleaned for mud, it will restrict production of reservoir fluid and increased production will be possible from the remaining sections of the well, which still contain drill mud.

After some time, typically 6-12 hours, the remaining soluble substance 40 within the left housing 3*m* will be dissolved, opening up for flow through top opening 7' of the housing 3*m*, via the subsequent housings 3*g* and 3*w* and out through the main outlet 8 of the apparatus 1. A normal operation mode will then be established.

The soluble substances 40 surrounding the flow control means 9*g* and 9*w* in the housing 3*g* and 3*w* respectively are introduced to ensure correct initial placement during running of completion and initial well start-up/cleanup.

Another setup enabling improved cleanup of the well W is by different configuration of the order of the housings 3*m*, 3*g* and 3*w*, as shown in for example FIG. 3, in the heel, mid and toe section of the well W. This configuration enables improved cleanup functionality without the use of soluble substance and is not requiring a particular type of drilling mud (oil- or water-based) when drilling the well. Typically, the apparatus configuration shown in FIG. 10 will be installed in the heel and mid section of the well W while a configuration of the apparatus 1 as shown in FIG. 3 will be installed in the toe section. In FIG. 10 the flow control means 9*m* is positioned in a housing 3*m* at the end of apparatus 1.

The flow control means 9*m* in FIG. 10 has a density lower than that of the well construction fluid (drilling mud), and higher than that of the formation water. Initially, prior to cleanup, all the flow control means 9*m*, 9*g* and 9*w* in FIG. 10 have a density lower than that of the surrounding drill mud and will therefore be buoyant. The fluid flow will enter the main inlet 4, pass through bypass channels 13 and 13' and out the main outlet 8.

When the section of the well W comprising the apparatus 1 is cleaned for mud and oil and starts to flow, flow control means 9*m* will lose its buoyancy and sink down to create a seal with the lower outlet 7 of the housing 3*m*. Flow control means 9*w* will due to suction forces remain in position and keep its tight seal with the top opening 7' of the housing 3*w*. At this moment there are no open flow paths from main inlet 4 to main outlet 8, except through the leak holes 11.

As the apparatus 1 disclosed in FIG. 10 shuts off production after being cleaned for well construction fluids, sections (typically the well toe) where a plurality apparatuses described in FIG. 3 are installed, will have improved cleanup as a larger part of the well production will come from these sections. When the well cleanup is finished, the apparatuses 1 will be autonomously adapted to the relevant reservoir fluid. At this point, based on an initial well start-up procedure, the well will be shut in before re-opened for production. In this shut-in period, the flow control means of all apparatuses 1 will not be exposed to suction forces and the flow control means 9*m*, 9*g*, 9*w* will find their correct positions inside their respective housings 3*m*, 3*g*, 3*w* based on their density and the density of the respective reservoir fluid. In an oil producer, as described here, if sections of the well are exposed to free gas or formation water, the apparatuses in these sections will be restricting the fluid flow by either flow control means 9*g* (if free gas is present) or flow control means 9*w* if formation water is present.

FIG. 11 is a simplified concept drawing of the apparatus 1 shown in FIG. 3, wherein the apparatus 1 is further provided with a bypass channel 50. Such a bypass channel 50 is part of a fail-safe or late-life well conversion mechanism and will therefore also be denoted a fail-safe control means.

The bypass channel 50 is provided with a flow control means 9*b* enclosed in a soluble substance 52.

The apparatus 1 is further provided with a portion of the main inlet 4 having a size and form configured to create a tight seal with the flow control means 9*b* when the soluble substance is dissolved and is no longer capable of holding the control means 9*b* within the channel 50. A free flowing flow control means 9*b* will be moved towards the inlet only when the fluid flows from within the pipe P and up through the bypass channel 50 and towards the main inlet 4, i.e. in the opposite direction of the two arrows in the upper left part of FIG. 11.

The flow control means 9*b* may be made of for example a hard hydrocarbon soluble substance. If for some reason the apparatus 1 described in FIG. 3 (and indicated in FIG. 11) does not work as desired, the well could be flushed with e.g. an acid having dissolving properties to the soluble substance 52 so that this will wash out and the flow control means 9*b* will be freed from the bypass channel and move towards and create a tight seal with the main inlet 4 of the apparatus 1, preventing further flow of acid into the reservoir.

When well production at a later stage commences, the flow control means 9*b* will be stopped by a fluid permeable restriction means. The fluid permeable restriction means may for example be a grating 54 being sufficiently permeable to allow fluid flowing through. The control means 9*b* will then be dissolved by the reservoir fluid, allowing for later bullheading of fluids into the well. The open bypass channel 50 will enable fluid flow from the reservoir without restriction as if the apparatus 1 was never installed.

FIG. 12 shows an example of another embodiment of the apparatus according to the present invention having a different configuration of the flow restrictors and the fail-safe or late-life well conversion mechanism. FIG. 12 shows a typical configuration where an oil producer shall be able to convert to a gas producer in late-life production, while still keeping the functionality and possibility to discriminate/restrict formation water from the reservoir.

FIG. 13 shows a configuration of flow restrictors with multiple fail-safe and well conversion possibilities. The functionality described for FIG. 12 is intact, with possibility for washout of a soluble substance 62 being in a bypass channel 60 completely bypassing the functionality of the apparatus 1 and achieve complete fail-safe functionality. The soluble substance 52 within the bypass channel 50 will have a different characteristic from the soluble substance 62 within the second bypass channel so that they will dissolve in different fluids, typically two different acids. By using different soluble substances 52 and 62, more advanced fail-safe or conversion mechanisms can be achieved. The configuration in FIG. 13 allows for the possibility to convert the well from an oil producer into a gas producer in a possible late-life scenario, by washing out the soluble substance 52, while keeping the soluble substance 62. If at some point in the well lifetime it is desirable to completely bypass the functionality of the apparatus 1, e.g. if the desired functionality is not met or if extended sweeps of water should be allowed during late life production, washout of soluble substance 62 will enable complete bypass of the device.

As an additional fail-safe mechanism, a sliding sleeve 72 of a type known per se is in the embodiment shown included to open a third bypass channel 70. The sliding sleeve 72 is operated by means of a tool known per se run into the basepipe P.

An apparatus as shown in for example FIG. 3 and FIGS. 4*a*-4*d* could be configured to be installed on the outside of a basepipe P as shown in principle in FIG. 11. However, the apparatus 1 may alternatively be configured for installation inside or at the end of the completion. The main inlet 4 and the main outlet 8 of the apparatus 1 will then be in direct fluid communication with the flow within the completion. This allows for the possibility of total blocking of the fluid flow from an entire section, e.g. the toe section.

From the above it will be apparent that the apparatus according to the present invention provides an autonomous valve for allowance of production of desired well fluids, and the self-sensing characteristics of the valve which will choke and reduce the production rates of undesired fluids when present.

By installing series of autonomous valves along the reservoir section of a well, several benefits may be achieved:

Initial clean-up or mud removal will be improved;

The initial production of oil may be kept high;

Undesired fluids (typically gas and/or water) may be choked back or blocked immediately, as the individual valves autonomously will restrict gas influx locally in the completion.

By combining the valves with ECP's (External Casing Packers) or formation packers (swell packers), which will restrict axial flow in a wellbore annulus, an extremely reliable drainage may be achieved for drainage of preferred fluids in thin, high permeable formations or from long reach wells in complex structures with high degree of uncertainty. Such completions will ensure optimum production, independent of undesired influx from the reservoir.

The invention claimed is:

1. An orientation dependent inflow control apparatus (20) for controlling fluid flow from an outside to an inside of a pipe (P) in a deviated or horizontal well (W), the inflow control apparatus (20) comprising:

a first housing (22) having a longitudinal axis and provided with a first inlet (24) being in fluid communication with fluid outside of the pipe (P), and a first outlet (26);

a second housing (28) having a longitudinal axis and provided with a second inlet (30) and a second outlet (32);

wherein said outlets (26, 32) being provided in an end portion of the housings (22, 28), the first outlet (26) being in fluid communication with the second inlet (30) and the second outlet (32) being arranged for fluid communicating with an inside of the pipe (P);

a movable blocking member (22*b*, 28*b*) arranged within each of the housings (22, 28) and configured for allowing blockage of the of first and second outlets (26, 32) by moving along said longitudinal axis by gravity or buoyancy towards the end portion having the outlet (26, 32), the movable blocking member (22*b*, 28*b*) having a density being higher than a highest density fluid present in the well (W) during at least a period of a lifespan of the well or lower than a lowest density fluid present in the well (W) during at least a period of the lifespan of the well, wherein the first housing (22) and the second housing (28) are arranged mutually distant in or at a perimeter of the pipe (P) such that an angle of inclination of the first housing (22) is different from that of the second housing (28).

2. The orientation dependent inflow control apparatus (20) according to claim 1, wherein the outlet (32) from the second housing (28) is arranged for fluid communicating with the inside of the pipe via the apparatus (1).

3. The orientation dependent inflow control apparatus (20) according to claim 1, comprising at least two inflow control apparatuses (20) distributed around the pipe (P).

4. An apparatus (1) for controlling fluid flow in or into a well, the apparatus being mounted onto or in a portion of a wellpipe, the apparatus comprising:

at least a first housing and a second housing arranged in series between a main inlet (4) being in fluid communication with fluid upstream of the apparatus (1) and a main outlet (8) being in fluid communication with fluid downstream of the apparatus (1), each of the housings (3*m*, 3*g*, 3*w*) having a top portion located in an upper elevation of the housing and a bottom portion located in a lower elevation of the housing when the apparatus (1) is in a position of use, each of the housing (3*m*, 3*g*, 3*w*) further having:

an inlet (5) for allowing fluid flow into the housing (3*m*, 3*g*, 3*w*); and at least one outlet (7, 7') for allowing fluid flow out of the housing (3*m*, 3*g*, 3*w*), the outlet (7, 7') being arranged in one or both of the top portion and the bottom portion of the housing (3*m*, 3*g*, 3*w*), where one of the at least one outlet (7, 7') from one housing is in fluid communication with the inlet (5) of a subsequent housing in the series of housings;

one flow control means (9*m*, 9*g*, 9*w*) disposed movably within each of the housing (3*m*, 3*g*, 3*w*) between said top portion and bottom portion, the flow control means (9*m*, 9*g*, 9*w*) having:

a density being higher or lower than a density of a fluid to be controlled so that a position of the flow control means within the housing (3*m*, 3*g*, 3*w*)

depends on the density of the flow control means relative to the density of the fluid only, wherein the flow control means (9*m*, 9*g*, 9*w*) disposed in each of the housings (3*m*, 3*q*, 3*w*) has a density different from the density of the flow control means (9*m*, 9*a*, 9*w*) disposed in other housings; and a shape adapted to substantially block the outlet (7, 7') of the housing when the flow control means (9*m*, 9*g*, 9*w*) is in a position abutting the outlet (7, 7') in said top portion or the bottom portion; and a leakage means (11) configured for allowing leakage of fluid out of at least one of a top portion and a bottom portion of the housing (3*m*, 3*g*, 3*w*) independent of the position of the flow control means (9*m*, 9*g*, 9*w*).

5. The apparatus (1) according to claim 4, wherein the leakage means (11) is an aperture (11) provided in a portion of the housing (3*m*, 3*g*, 3*w*).

6. The apparatus (1) according to claim 5, wherein the aperture (11) is arranged outside of the periphery of the outlet (7, 7').

7. The apparatus (1) according to claim 4, wherein the leakage means (11) is provided by means of a surface of the flow control means (9*m*, 9*g*, 9*w*) being non-compliant with a periphery of the outlet (7, 7') so that a desired leakage is provided therebetween.

8. The apparatus (1) according to claim 7, wherein the flow control means (9*m*, 9*g*, 9*w*) has a spherical shape.

9. The apparatus (1) according to claim 4, wherein the flow control means (9*m*, 9*g*, 9*w*) is arranged freely within the housing (3*m*, 3*g*, 3*w*).

10. The apparatus (1) according to claim 4, wherein a portion of at least one of the housing (3*m*, 3*g*, 3*w*) is provided with a fluid soluble substance (40) for initially fixing the flow control means (9*m*, 9*g*, 9*w*) in a predetermined position.

11. The apparatus (1) according to claim 4, further provided with at least one bypass means (50) comprising a channel for bypassing at least one housing (3*m*, 3*g*, 3*w*), the bypass means being provided with a fail-safe flow control means (9*b*) arranged in a portion of the channel.

12. The apparatus (1) according to claim 11, wherein a fluid permeable restriction means is arranged in a portion of the bypass means (50) for preventing the fail-safe flow control means (9*b*) flowing out of the apparatus (1).

13. The apparatus (1) according to claim 11, wherein the fail safe flow control means is fixed in the bypass means (50) by means of a soluble substance sealing (40, 52, 62) off the bypass means (50).

14. A method for controlling fluid flow in or into a well (NV), the method comprising the steps of:

mounting an apparatus (1) according to claim 1 as part of a well completion string (CS) prior to inserting the string in the well (W), the apparatus (1) comprising at least a first housing and a second housing arranged in series between a main inlet (4) being in fluid communication with fluid upstream of the apparatus (1) and a main outlet (8) being in fluid communication with fluid downstream of the apparatus (1), each of the housings (3*m*, 3*g*, 3*w*) having a top portion located in an upper elevation of the housings and a bottom portion located in a lower elevation of the housings when the apparatus (1) is in a position of use, each of the housings (3*m*, 3*g*, 3*w*) further having:

an inlet (5) for allowing fluid flow into the housing (3*m*, 3*g*, 3*w*); and at least one outlet (7, 7') for allowing fluid flow out of the housing (3*m*, 3*g*, 3*w*), the outlet (7, 7') being arranged in one or both of the top portion and the bottom portion of the housing (3*m*, 3*g*, 3*w*), where one of the at least one outlet (7, 7') from one housing is in fluid communication with the inlet (5) of a subsequent housing in the series of housings; one flow control means (9*m*, 9*g*, 9*w*) disposed movably within each of the housings (3*m*, 3*g*, 3*w*) between said top portion and bottom portion, the flow control means (9*m*, 9*g*, 9*w*) having:

a density being higher or lower than a density of a fluid to be controlled so that a position of the flow control means within the housing (3*m*, 3*g*, 3*w*) depends on the density of the flow control means relative to the density of the fluid only, wherein the flow control means (9*m*, 9*g*, 9*w*) disposed in each of the housings (3*m*, 3*q*, 3*w*) has a density different from the density of the flow control means (9*m*, 9*g*, 9*w*) disposed in other housings; and a shape adapted to substantially block the outlet (7, 7') of the housing when the flow control means (9*m*, 9*g*, 9*w*) is in a position abutting the outlet (7, 7') in said top portion or the bottom portion; and a leakage means (11) configured for allowing leakage of fluid out of at least one of a top portion and a bottom portion of the housings (3*m*, 3*g*, 3*w*) independent of the position of the flow control means (9*m*, 9*g*, 9*w*); and bringing the well completion string (CS) into the well.

15. The method according to claim 14, further comprising orienting the apparatus (1) during completion of the well.

16. The method according to claim 14, further comprising mounting an orientation dependent inflow control apparatus (20) to the well completion string (CS), the inflow control apparatus comprising: a first housing (22) having a longitudinal axis and provided with a first inlet (24) being in fluid communication with fluid outside of the pipe (P), and a first outlet (26);

a second housing (28) having a longitudinal axis and provided with a second inlet (30) and a second outlet (32);

wherein said outlets (26, 32) being provided in an end portion of the housings (22, 28), the first outlet (26) being in fluid communication with the second inlet (30) and the second outlet (32) being arranged for fluid communicating with an inside of the pipe (P);

a movable blocking member (22*b*, 28*b*) arranged within each of the housing (22, 28) and configured for allowing blockage of the first and second outlets (26, 32) by moving along said longitudinal axis by gravity or buoyancy towards the end portion having the outlet (26, 32), the movable blocking member (22*b*, 28*b*) having a density being higher than the a highest density fluid present in the well (W) during at least a period of a lifespan of the well or lower than a lowest density fluid present in the well (W) during at least a period of the lifespan of the well, wherein the first housing (22) and the second housing (28) are arranged mutually distant in or at a perimeter of the pipe (P) such that an angle of inclination of the first housing (22) is different from that of the second housing (28), wherein the outlet (32) from the second housing (28) is arranged for fluid communicating with the inside of the pipe via the apparatus (1).

17. The method according to claim 14, the method further comprising:

providing the apparatus (1) with at least bypass means (50) wherein a fluid permeable restriction means is arranged in a portion of the bypass means (50) for preventing the fail-safe flow control means (9*b*) provided within the at least one bypass means from flowing out of the apparatus (1);

and retaining the fail safe control means (9*b*) within the bypass means (50) by means of a soluble substance (40, 52, 62) sealing off the bypass means (50); and if or when desired subjecting the soluble substance (40, 52, 62) to a fluid dissolving the soluble substance and thereby releasing and activating the fail-safe control means (9*b*).

* * * * *